US010373623B2

(12) United States Patent
Dittmar et al.

(10) Patent No.: US 10,373,623 B2
(45) Date of Patent: Aug. 6, 2019

(54) APPARATUS AND METHOD FOR PROCESSING AN AUDIO SIGNAL TO OBTAIN A PROCESSED AUDIO SIGNAL USING A TARGET TIME-DOMAIN ENVELOPE

(71) Applicant: Fraunhofer-Gesellschaft zur Foerderung der angewandten Forschung e.V., Munich (DE)

(72) Inventors: Christian Dittmar, Erlangen (DE); Meinard Mueller, Erlangen (DE); Sascha Disch, Fuerth (DE)

(73) Assignee: Fraunhofer-Gesellschaft zur Foerderung der angewandten Forschung e.V., Munich (DE)

( * ) Notice: Subject to any disclaimer, the term of this patent is extended or adjusted under 35 U.S.C. 154(b) by 3 days.

(21) Appl. No.: 15/682,123

(22) Filed: Aug. 21, 2017

(65) Prior Publication Data

US 2017/0345433 A1 Nov. 30, 2017

Related U.S. Application Data

(63) Continuation of application No. PCT/EP2016/053752, filed on Feb. 23, 2016.

(30) Foreign Application Priority Data

Feb. 26, 2015 (EP) ..... 15156704
Aug. 14, 2015 (EP) ..... 15181118

(51) Int. Cl.
*G10L 13/04* (2013.01)
*G10L 19/03* (2013.01)
(Continued)

(52) U.S. Cl.
CPC ..... *G10L 19/03* (2013.01); *G10L 13/04* (2013.01); *G10L 21/0272* (2013.01); *G10L 21/0388* (2013.01); *G10L 25/03* (2013.01)

(58) Field of Classification Search
CPC ..... G10L 19/00; G10L 19/03; G10L 21/0388; G10L 13/04; G10L 25/03
See application file for complete search history.

(56) References Cited

U.S. PATENT DOCUMENTS 8,260,611 B2 9/2012 Vos et al.
2005/0222840 A1 10/2005 Smaragdis
(Continued)

FOREIGN PATENT DOCUMENTS

EP 1875464 B1 12/2012
EP 2631906 A1 8/2013
(Continued)

OTHER PUBLICATIONS

Moreno Bilbao, M. Asunción, and Miguel A. Lagunas Hernandez. "Envelope and instantaneous phase considerations in speech modelling." ISCAS 1988: the IEEE International Symposium on Circuits and Systems: proceedings. Institute of Electrical and Electronics Engineers (IEEE), 1988. (Year: 1988).*
(Continued)

*Primary Examiner* — Brian L Albertalli
(74) *Attorney, Agent, or Firm* — Perkins Coie LLP; Michael A. Glenn

(57) ABSTRACT

Subject of the invention is an apparatus described by a schematic block diagram for processing an audio signal to obtain a processed audio signal. The apparatus includes a phase calculator for calculating phase values for spectral values of a sequence of frequency-domain frames representing overlapping frames of the audio signal. Moreover, the phase calculator is configured to calculate the phase values
(Continued)

based on information on a target time-domain envelope related to the processed audio signal, so that the processed audio signal has at least in an approximation the target time-domain envelope and a spectral envelope determined by the sequence of frequency-domain frames.

25 Claims, 24 Drawing Sheets

(51) Int. Cl.
*G10L 21/0272* (2013.01)
*G10L 21/0388* (2013.01)
*G10L 25/03* (2013.01)

(56) References Cited

U.S. PATENT DOCUMENTS

2005/0261896 A1 11/2005 Schuijers et al.
2006/0064299 A1* 3/2006 Uhle ..... G06K 9/6242 704/212
2011/0251846 A1 10/2011 Liu et al.
2015/0051904 A1* 2/2015 Kikuiri ..... G10L 19/265 704/205
2015/0302845 A1* 10/2015 Nakano ..... G10L 13/02 704/267
2016/0118056 A1* 4/2016 Choo ..... G10L 19/002 381/100

FOREIGN PATENT DOCUMENTS

JP H10513282 12/1998
JP 2005258440 9/2005
JP 2012511184 5/2012
RU 2351006 C2 3/2009
RU 2523173 C2 7/2014
WO 9719444 5/1997
WO 2011039668 A1 4/2011
WO 2015087107 A1 6/2015

OTHER PUBLICATIONS

Quatieri, Thomas F., R. B. Dunn, and T. E. Hanna. "Time-scale modification of complex acoustic signals." Acoustics, Speech, and Signal Processing, 1993. ICASSP-93., 1993 IEEE International Conference on. vol. 1. IEEE, 1993. (Year: 1993).*
Quatieri, T. "Minimum and mixed phase speech analysis-synthesis by adaptive homomorphic deconvolution." IEEE Transactions on Acoustics, Speech, and Signal Processing 27.4 (1979): 328-335. (Year: 1979).*
Cano, et al., "Influence of phase, magnitude and location of harmonic components in the perceived quality of extracted solo signals", Proceedings of the Audio Engineering Society (AES) Conference on Semantic Audio, Ilmenau, Germany, Jul. 2011, pp. 247-252.
Dittmar, et al., "Real-time transcription and separation of drum recordings based on nmf decomposition", Proceedings of the International Conference on Digital Audio Effects (DAFx), Erlangen, Germany, Sep. 1-5, 2014, pp. 187-194.
Driedger, et al., "Extending harmonic-percussive separation of audio signals", 15th International Society for Music Information Retrieval Conference (ISMIR 2014), Taipei, Taiwan, Oct. 2014, pp. 611-617.
Driedger, et al., "Improving time-scale modification of music signals using harmonic-percussive separation", IEEE Signal Processing Letters, vol. 21, No. 1, Jan. 2014, pp. 105-109.
Edler, , "Coding of Audio Signals with Overlapping Block Transform and Adaptive Window Functions", Frequenz, vol. 43, No. 9,, Sep. 1989, pp. 252-256.
Fitzgerald, "Harmonic/Percussive Separation Using Median Filtering", Proceedings International Conference on Digital Audio Effects (DAFx), Graz, Austria, Sep. 6-10, 2010, pp. 246-253.
Gerkmann, et al., "Phase Processing for Single-Channel Speech Enhancement: History and recent advances", IEEE Signal Processing Magazine, vol. 32, No. 2, Mar. 2015, pp. 55-66.
Gnann, et al., "Inversion of short-time fourier transform magnitude spectrograms with adaptive window lengths", Proceedings of the IEEE International Conference on Acoustics, Speech, and Signal Processing, (ICASSP), Taipei, Taiwan, Apr. 2009, pp. 325-328.
Gnann, et al., "Signal Reconstruction from Multiresolution STFT Magnitudes with Mutual Initialization", AES 45th International Conference: Applications of Time-Frequency Processing in Audio, Mar. 1-4, 2012, pp. 1-6.
Griffin, et al., "Signal estimation from modified short-time Fourier transform", IEEE Transactions on Acoustics, Speech and Signal Processing, vol. 32, No. 2, Apr. 1984, pp. 236-243.
Gunawan, et al., "Music source separation synthesis using Multiple Input Spectrogram Inversion", Multimedia Signal Processing, 2009. MMSP '09. IEEE International Workshop on, IEEE, Oct. 5-7, 2009, pp. 1-5.
Herre, et al., "Enhancing the Performance of Perceptual Audio Coders by Using Temporal Noise Shaping (TNS)", Proceedings of the Audio Engineering Society (AES) Convention, Los Angeles, USA, Preprint 4384., Nov. 1996, 24 pages.
Le Roux, et al., "Explicit consistency constraints for STFT spectrograms and their application to phase reconstruction", Proceedings of the ISCA Tutorial and Research Workshop on Statistical and Perceptual Audition, Brisbane, Australia, Sep. 2008, pp. 23-28.
Le Roux, et al., "Fast signal reconstruction from magnitude STFT spectrogram based on spectrogram consistency", Proceedings International Conference on Digital Audio Effects (DAFx), Graz, Austria, Sep. 6-10, 2010, 7 pages.
Le Roux, et al., "Phase initialization schemes for faster spectrogram-consistency-based signal reconstruction", Proceedings of the Acoustical Society of Japan Autumn Meeting, No. 3-10-3, Sep. 2010, pp. 601-602.
Nakamura, et al., "Fast signal reconstruction from magnitude spectrogram of continuous wavelet transform based on spectrogram consistency", Proceedings of the International Conference on Digital Audio Effects (DAFx), Erlangen, Germany, Sep. 1-5, 2014, pp. 129-135.
Niemeyer, et al., "Detection and extraction of transients for audio coding", Proceedings of the Audio Engineering Society (AES) 120th Convention, Paris, France, Convention Paper 6811, May 20-23, 2006, 8 pages.
Perraudin, et al., "A fast Griffin-Lim algorithm", Proceedings IEEE Workshop on Applications of Signal Processing to Audio and Acoustics (WASPAA), New Paltz, NY, USA, Oct. 20-23, 2013, pp. 1-4.
Robel, Axel , "A New Approach to Transient Processing in the Phase Vocoder", Proc. of the 6th Int. Conference on Digital Audio Effects, London, UK, Sep. 8-11, 2003, DAFX 1-6.
Sturmel, et al., "Signal reconstruction from STFT magnitude: a state of the art", Proceedings of the International Conference on Digital Audio Effects (DAFx), Paris, France, Sep. 2011, pp. 375-386.
Sun, et al., "Estimating a signal from a magnitude spectrogram via convex optimization", Proceedings of the Audio Engineering Society (AES) Convention, San Francisco, USA, Preprint 8785, Oct. 26, 2012{29, 7 pages.
Zhu, , "Real-time signal estimation from modified short-time Fourier transform magnitude spectra", IEEE Transactions on Audio, Speech, and Language Processing, vol. 15, No. 5, Jul. 2007, pp. 1645-1653.

* cited by examiner

APPARATUS AND METHOD FOR PROCESSING AN AUDIO SIGNAL TO OBTAIN A PROCESSED AUDIO SIGNAL USING A TARGET TIME-DOMAIN ENVELOPE

CROSS-REFERENCE TO RELATED APPLICATIONS

This application is a continuation of copending International Application No. PCT/EP2016/053752, filed Feb. 23, 2016, which is incorporated herein by reference in its entirety, and additionally claims priority from European Applications Nos. EP 15 156 704.7, filed Feb. 26, 2015, and EP 15 181 118.9, filed Aug. 14, 2015, each of which is incorporated herein by reference in its entirety.

FIELD OF THE INVENTION

The present invention relates to an apparatus and a method for processing an audio signal to obtain a processed audio signal. Embodiments further show an audio decoder comprising the apparatus and a corresponding audio encoder, an audio source separation processor and a bandwidth enhancement processor, both comprising the apparatus. According to further embodiments, transient restoration in signal reconstruction and transient restoration in score-informed audio decomposition is shown.

BACKGROUND OF THE INVENTION

The task of separating a mixture of superimposed sound sources into its constituent components has gained importance in digital audio signal processing. In speech processing, these components are usually the utterances of target speakers interfered by noise or simultaneously speaking persons. In music, these components can be individual instrumental or vocal melodies, percussive instruments, or even individual note events. Relevant topics are signal reconstruction and transient preservation and score-informed audio composition (i.e. source separation).

Music source separation aims at decomposing a polyphonic, multitimbral music recording into component signals such as singing voice, instrumental melodies, percussive instruments, or individual note events occurring in a mixture signal. Besides being an important step in many music analysis and retrieval tasks, music source separation is also a fundamental prerequisite for applications such as music restoration, upmixing, and remixing. For these purposes, high fidelity in terms of perceptual quality of the separated components is desirable. The majority of existing separation techniques work on a time-frequency (TF) representation of the mixture signal, often the Short-Time Fourier Transform (STFT). The target component signals are usually reconstructed using a suitable inverse transform, which in turn can introduce audible artifacts such as musical noise, smeared transients or pre-echos. Existing approaches suffer from audible artifacts in the form of musical noise, phase interference and pre-echos. These artifacts are often quite disturbing for the human listener.

There is a number of recent papers on music source separation. In most approaches, the separation is carried out in the time-frequency (TF) domain by modifying the magnitude spectrogram. The corresponding time-domain signals of the separated components are derived by using the original phase information and applying suitable inverse transforms. When striving for good perceptual quality of the separated solo signals, many authors revert to score-informed decomposition techniques. This has the advantage that the separation can be guided by information on the approximate location of component signals in time (onset, offset) and frequency (pitch, timbre). Fewer publications deal with source separation of transient signals such as drums. Others have focused on the separation of harmonic vs. percussive components [5].

Moreover, the problem of pre-echos has been addressed in the field of perceptual audio coding, where pre-echos are typically caused by the use of relatively long analysis and synthesis windows in conjunction with intermediate manipulation of TF bins such as quantization of spectral magnitudes according to a psycho-acoustic model. It can be considered state-of-the-art to use block-switching in the vicinity of transient events [6]. An interesting approach was proposed in [13] where spectral coefficients are encoded by linear prediction along the frequency axis, automatically reducing pre-echos. Later works proposed to decompose the signal into transient and residual components and use optimized coding parameters for each stream [3]. Transient preservation has also been investigated in the context of time-scale modification methods based on the phase-vocoder. In addition to optimized treatment of the transient components, several authors follow the principle of phase-locking or re-initialization of phase in transient frames [8].

The problem of signal reconstruction, also known as magnitude spectrogram inversion or phase estimation is a well-researched topic. In their classic paper [1], Griffin and Lim proposed the so-called LSEE-MSTFTM algorithm for iterative, blind signal reconstruction from modified STFT magnitude (MSTFTM) spectrograms. In [2], Le Roux et al. developed a different view on this method by describing it using a TF consistency criterion. By keeping the operations entirely in the TF domain, several simplifications and approximations could be introduced that lower the computational load compared to the original procedure. Since the phase estimates obtained using LSEE-MSTFTM can only converge to local optima, several publications were concerned with finding a good initial estimate for the phase information [3, 4]. Sturmel and Daudet [5] provided an in-depth review of signal reconstruction methods and pointed out unsolved problems. An extension of LSEE-MSTFTM with respect to convergence speed was proposed in [6]. Other authors tried to formulate the phase estimation problem as a convex optimization scheme and arrived at promising results hampered by high computational complexity [7]. Another work [8] was concerned with applying the spectrogram consistency framework to signal reconstruction from wavelet-based magnitude spectrograms.

However, the described approaches for signal reconstruction share the issue that a rapid change of the audio signal, which is, for example, typical for transients, may suffer from the earlier described artifacts such as, for example, pre-echos.

Therefore, there is a need for an improved approach.

SUMMARY

According to an embodiment, an apparatus for processing an audio signal to obtain a processed audio signal may have: a phase calculator for calculating phase values for spectral values of a sequence of frequency-domain frames representing overlapping frames of the audio signal, wherein the phase calculator is configured to calculate the phase values based on information on a target time-domain envelope related to the processed audio signal, so that the processed audio signal has at least in an approximation the target time-domain envelope and a spectral envelope determined by the sequence of frequency-domain frames.

According to another embodiment, an audio encoder for encoding an audio signal may have: an audio signal processor configured for encoding the audio signal such that the encoded audio signal has a representation of a sequence of frequency-domain frames of the audio signal and a representation of a target time-domain envelope, and an envelope determiner configured for determining a time-domain envelope from the audio signal, wherein the envelope determiner is further configured to compare the envelope to a set of predetermined envelopes to determine a representation of the target time-domain envelope based on the comparing.

According to another embodiment, an audio decoder may have: an inventive apparatus, and an input interface for receiving an encoded signal, the encoded signal having a representation of the sequence of frequency-domain frames and a representation of the target time-domain envelope.

According to another embodiment, an audio signal may have: a representation of a sequence of frequency-domain frames of the time-domain audio signal and a representation of a target time-domain envelope.

According to another embodiment, an audio source separation processor may have: an inventive apparatus, and a spectral masker for masking a spectrum of an original audio signal to obtain a modified audio signal input into the apparatus for processing, wherein the processed audio signal is a separated source signal related to the target time-domain envelope.

According to another embodiment, a bandwidth enhancement processor for processing an encoded audio signal may have: an enhancement processor for generating an enhancement signal from an audio signal band included in the encoded signal, and an inventive apparatus for processing, wherein the enhancement processor is configured to extract the target time-domain envelope from an encoded representation included in the encoded signal or from the audio signal band included in the encoded signal.

According to another embodiment, a method for processing an audio signal to obtain a processed audio signal may have the steps of: calculating phase values for spectral values of a sequence of frequency-domain frames representing overlapping frames of the audio signal, wherein the phase values are calculated based on information on a target time-domain envelope related to the processed audio signal, so that the processed audio signal has at least in an approximation the target time-domain envelope and a spectral envelope determined by the sequence of frequency-domain frames.

According to another embodiment, a method of audio decoding may have: the method for processing an audio signal to obtain a processed audio signal having the steps of: calculating phase values for spectral values of a sequence of frequency-domain frames representing overlapping frames of the audio signal, wherein the phase values are calculated based on information on a target time-domain envelope related to the processed audio signal, so that the processed audio signal has at least in an approximation the target time-domain envelope and a spectral envelope determined by the sequence of frequency-domain frames; receiving an encoded signal, the encoded signal having a representation of the sequence of frequency-domain frames, and a representation of the target time-domain envelope.

According to another embodiment, a method of audio source separation may have: the method for processing an audio signal to obtain a processed audio signal having the steps of: calculating phase values for spectral values of a sequence of frequency-domain frames representing overlapping frames of the audio signal, wherein the phase values are calculated based on information on a target time-domain envelope related to the processed audio signal, so that the processed audio signal has at least in an approximation the target time-domain envelope and a spectral envelope determined by the sequence of frequency-domain frames, and masking a spectrum of an original audio signal to obtain a modified audio signal input into the apparatus for processing; wherein the processed audio signal is a separated source signal related to the target time-domain envelope.

According to another embodiment, a method of bandwidth enhancement of an encoded audio signal may have: generating an enhancement signal from an audio signal band included in the encoded signal; the method for processing an audio signal to obtain a processed audio signal having the steps of: calculating phase values for spectral values of a sequence of frequency-domain frames representing overlapping frames of the audio signal, wherein the phase values are calculated based on information on a target time-domain envelope related to the processed audio signal, so that the processed audio signal has at least in an approximation the target time-domain envelope and a spectral envelope determined by the sequence of frequency-domain frames; wherein the generating includes extracting the target time-domain envelope from an encoded representation included in the encoded signal or from the audio signal band included in the encoded signal.

According to another embodiment, a method of audio encoding may have the steps of: encoding the audio signal such that the encoded audio signal has a representation of a sequence of frequency-domain frames of the audio signal and a representation of a target time-domain envelope; and determining a time-domain envelope from the audio signal and comparing the envelope to a set of predetermined envelopes to determine a representation of the target time-domain envelope based on the comparing.

Another embodiment may have a non-transitory digital storage medium having a computer program stored thereon to perform the method for processing an audio signal to obtain a processed audio signal having the steps of: calculating phase values for spectral values of a sequence of frequency-domain frames representing overlapping frames of the audio signal, wherein the phase values are calculated based on information on a target time-domain envelope related to the processed audio signal, so that the processed audio signal has at least in an approximation the target time-domain envelope and a spectral envelope determined by the sequence of frequency-domain frames, when said computer program is run by a computer.

Another embodiment may have a non-transitory digital storage medium having a computer program stored thereon to perform the method of audio decoding having: the method for processing an audio signal to obtain a processed audio signal, having the steps of: calculating phase values for spectral values of a sequence of frequency-domain frames representing overlapping frames of the audio signal, wherein the phase values are calculated based on information on a target time-domain envelope related to the processed audio signal, so that the processed audio signal has at least in an approximation the target time-domain envelope and a spectral envelope determined by the sequence of frequency-domain frames; receiving an encoded signal, the encoded signal having a representation of the sequence of frequency-domain frames, and a representation of the target time-domain envelope, when said computer program is run by a computer.

Another embodiment may have a non-transitory digital storage medium having a computer program stored thereon to perform the method of audio source separation having: the method for processing an audio signal to obtain a processed audio signal, having the steps of: calculating phase values for spectral values of a sequence of frequency-domain frames representing overlapping frames of the audio signal, wherein the phase values are calculated based on information on a target time-domain envelope related to the processed audio signal, so that the processed audio signal has at least in an approximation the target time-domain envelope and a spectral envelope determined by the sequence of frequency-domain frames, and masking a spectrum of an original audio signal to obtain a modified audio signal input into the apparatus for processing; wherein the processed audio signal is a separated source signal related to the target time-domain envelope, when said computer program is run by a computer.

Another embodiment may have a non-transitory digital storage medium having a computer program stored thereon to perform the method of bandwidth enhancement of an encoded audio signal having: generating an enhancement signal from an audio signal band included in the encoded signal; the method for processing an audio signal to obtain a processed audio signal, having the steps of: calculating phase values for spectral values of a sequence of frequency-domain frames representing overlapping frames of the audio signal, wherein the phase values are calculated based on information on a target time-domain envelope related to the processed audio signal, so that the processed audio signal has at least in an approximation the target time-domain envelope and a spectral envelope determined by the sequence of frequency-domain frames; wherein the generating includes extracting the target time-domain envelope from an encoded representation included in the encoded signal or from the audio signal band included in the encoded signal, when said computer program is run by a computer.

Another embodiment may have a non-transitory digital storage medium having a computer program stored thereon to perform the method of audio encoding having the steps of: encoding the audio signal such that the encoded audio signal has a representation of a sequence of frequency-domain frames of the audio signal and a representation of a target time-domain envelope; and determining a time-domain envelope from the audio signal and comparing the envelope to a set of predetermined envelopes to determine a representation of the target time-domain envelope based on the comparing, when said computer program is run by a computer.

The present invention is based on the finding that a target time-domain amplitude envelope can be applied to the spectral values of the sequence of frequency-domain frames in time or frequency-domain. In other words, a phase of a signal may be corrected after signal processing using time-frequency and frequency-time conversion, where an amplitude or a magnitude of this signal is still maintained or kept (unchanged). The phase may be restored using for example an iterative algorithm such as the algorithm proposed by Griffin and Lim. However, using the target time-domain envelope significantly improves the quality of the phase restoration, which results in a reduced number of iterations if the iterative algorithm is used. The target time-domain envelope may be calculated or approximated.

Embodiments show an apparatus for processing an audio signal to obtain a processed audio signal. The apparatus may comprise a phase calculator for calculating phase values for spectral values of a sequence of frequency-domain frames representing overlapping frames of the audio signal. The phase calculator may be configured to calculate the phase values based on information on a target time-domain envelope related to the processed audio signal, so that the processed audio signal has at least in an approximation the target time-domain envelope and a spectral domain envelope determined by the sequence of frequency-domain frames. The information on the target time-domain amplitude envelope may be applied to the sequence of frequency-domain frames in time or frequency-domain.

To overcome the aforementioned limitations of the known approaches, embodiments show a technique, method or an apparatus for better preserving transient components in reconstructed source signals. In particular, an objective may be to attenuate pre-echos that deteriorate onset clarity of note events from drums and percussion as well as piano and guitar.

Embodiments further show an extension or an improvement to the signal reconstruction procedure by Griffin and Lim [1] which e.g. better preserves transient signal components. The original method iteratively estimates the phase information used for time-domain reconstruction from a STFT magnitude (STFTM) by going back and forth between the STFT and the time-domain signal, only updating the phase information, while keeping the STFTM fixed. The proposed extension or improvement manipulates the intermediate time-domain reconstructions in order to attenuate the pre-echos that potentially precede the transients.

According to a first embodiment, the information on the target time-domain envelope is applied to the sequence of frequency-domain frames in time-domain. Therefore, a modified Short-Time Fourier Transform (MSTFT) may be derived from a sequence of frequency-domain frames. Based on the modified Short-Time Fourier Transform, an inverse Short-Time Fourier Transform may be performed. Since the Inverse Short-Time Fourier Transform (ISTFT) performs an overlap-and-add procedure, magnitude values and phase values of the initial MSTFT are changed (updated, adapted or adjusted). This leads to an intermediate time-domain reconstruction of the audio signal. Moreover, a target time-domain envelope may be applied to the intermediate time-domain reconstruction. This can e.g. be performed by convolving a time domain signal by an impulse response or by multiplying a spectrum by a transfer function. The intermediate time-domain reconstruction of the audio signal having (an approximation of) the target time-domain envelope may be time-frequency converted using a Short-Time Fourier Transform (STFT). Therefore, overlapping analysis- and/or synthesis windows may be used.

Even if the modulation of the target time-domain envelope is not applied, the STFT of the intermediate time-domain representation of the audio signal would be different from the earlier MSTFT due to the overlap-and-add procedure in the ISTFT and the STFT. This may be performed in an iterative algorithm, wherein, for an updated MSTFT, the phase value of the previous STFT operation is used and the corresponding amplitude or magnitude value is discarded. Instead, as an amplitude or magnitude value for the updated MSTFT, the initial magnitude values may be used, since it is assumed that the amplitude (or magnitude) value is (perfectly) reconstructed only having wrong phase information. Therefore, in each iteration step, the phase values are adapted to the correct (or original) phase values.

According to a second embodiment, the target time-domain envelope may be applied to the sequence of frequency-domain frames in frequency-domain. Therefore, the steps performed earlier in time-domain may be transferred (transformed, applied or converted) to the frequency-domain. In detail, this may be a time-frequency transform of the synthesis window of the ISTFT and the analysis window of the STFT. This leads to a frequency representation of neighboring frames that would overlap the current frame after the ISTFT and the STFT had been transformed in time-domain. However, this section is shifted to a correct position within the current frame, and an addition is performed to derive an intermediate frequency-domain representation of the audio signal. Moreover, the target time-domain envelope may be transformed to the frequency-domain, for example using an STFT, such that the frequency representation of the target time-domain envelope may be applied to the intermediate frequency-domain representation. Again, this procedure may be performed iteratively using the updated phase of the intermediate frequency-domain representation having (in an approximation) the envelope of the target time-domain envelope. Furthermore, the initial magnitude of the MSTFT is used, since it is assumed that the magnitude is already perfectly reconstructed.

Using the aforementioned apparatus, multiple further embodiments may be assumed to have different possibilities to derive the target time-domain envelope. Embodiments show an audio decoder comprising the aforementioned apparatus. The audio decoder may receive the audio signal from an (associated) audio encoder. The audio encoder may analyze the audio signal to derive a target time-domain envelope, for example for each time frame of the audio signal. The derived target time-domain envelope may be compared to a predetermined list of exemplary target time-domain envelopes. The predetermined target time-domain envelope which is closest to the calculated target time-domain envelope of the audio signal may be associated to a certain sequence of bits, for example a sequence of four bits to allocate 16 different target time-domain envelopes. The audio decoder may comprise the same predetermined target time-domain envelopes, for example a codebook or a lookup table, and is able to determine (read, compute or calculate) the (encoded) predetermined target time-domain envelope by the sequence of bits transmitted from the encoder.

According to further embodiments, the above-mentioned apparatus may be part of an audio source separation processor. An audio source separation processor may use a rough approximation of the target time-domain envelope, since an original audio signal having only one source of multiple sources of the audio signal is (usually) not available. Therefore, especially for transient restoration, a part of a current frame up to an initial transient position may be forced to be zero. This may effectively reduce pre-echos in front of a transient usually incorporated due to the signal processing algorithm. Furthermore, a common onset may be used as an approximation for the target time-domain envelope, e.g. the same onset for each frame. According to a further embodiment, a different onset may be used for different components of the audio signal e.g. derived from a predetermined list of onsets. For example, a target time-domain envelope or an onset of a piano may differ from a target time-domain envelope or an onset of a guitar, a hi-hat, or speech. Therefore, the current source or component for the audio signal may be analyzed, e.g. to detect the kind of audio information (instrument, speech etc) to determine the (theoretically) best-fitting approximation of the target time-domain envelope. According to further embodiments, the kind of audio information may be preset (by a user), if the audio source separation is e.g. intended to separate one or more instruments (e.g. guitar, hi-hat, flute, or piano) or speech from a remaining part of the audio signal. Based on the preset, a corresponding onset for the separated or isolated audio track may be chosen.

According to further embodiments, a bandwidth enhancement processor may use the aforementioned apparatus. The bandwidth enhancement processor uses a core coder to code a high resolution representation of one or more bands of the audio signal. Moreover, bands which are not coded using the core coder may be approximated in a bandwidth enhancement decoder using a parameter of the bandwidth enhancement encoder. The target time domain envelope may be transmitted, e.g. as a parameter, by the encoder. However, according to an embodiment, the target time-domain envelope is not transmitted (as a parameter) by the encoder. Therefore, the target time-domain envelope may be directly derived from the core decoded part or frequency band(s) of the audio signal. The shape or envelope of the core decoded part of the audio signal is a good approximation to the target time-domain envelope of the original audio signal. However, high-frequency components may be missing in the core-decoded part of the audio signal leading to a target time-domain envelope which may be less accentuated when compared to the original envelope. For example, the target time domain envelope may be similar to a low-pass filtered version of the audio signal or a part of the audio signal. However, the approximation of the target time-domain envelope from the core-decoded audio signal may be (on average) more precise compared to, for example, using a codebook where information of the target time-domain envelope may be transmitted from a bandwidth enhancement encoder to the bandwidth enhancement decoder.

According to further embodiments, an effective extension of the iterative signal reconstruction algorithm proposed by Griffin and Lim is shown. The extension shows an intermediate step within the iterative reconstruction using a modified Short-Time Fourier Transform. The intermediate step may enforce a desired or predetermined shape of the signal which shall be reconstructed. Therefore, a predetermined envelope may be applied on the reconstructed (time-domain) signal, for example using amplitude modulation, within each step of the iteration. Alternatively, the envelope may be applied to the reconstructed signal using a convolution of the STFT and the envelope in the time-frequency domain. The second approach may be advantageous or more effective, since the inverse STFT and the STFT may be emulated (performed, transformed or transferred) in the time-frequency domain and therefore, these steps do not need to be performed explicitly. Moreover, further simplifications, such as, for example, a sequence-selective processing may be realized. Moreover, an initialization of the phases (of the first MSTFT step) having meaningful values is advantageous, since a faster conversion is achieved.

Before embodiments are described in detail using the accompanying figures, it is to be pointed out that the same or functionally equal elements are given the same reference numbers in the figures and that a repeated description for elements provided with the same reference numbers is submitted. Hence, descriptions provided for elements having the same reference numbers are mutually exchangeable.

BRIEF DESCRIPTION OF THE DRAWINGS

Embodiments of the present invention will be detailed subsequently referring to the appended drawings, in which.

DETAILED DESCRIPTION OF THE INVENTION

In the following, embodiments of the invention will be described in further detail. Elements shown in the respective figures having the same or a similar functionality will have associated therewith the same reference signs.

Figure 1:
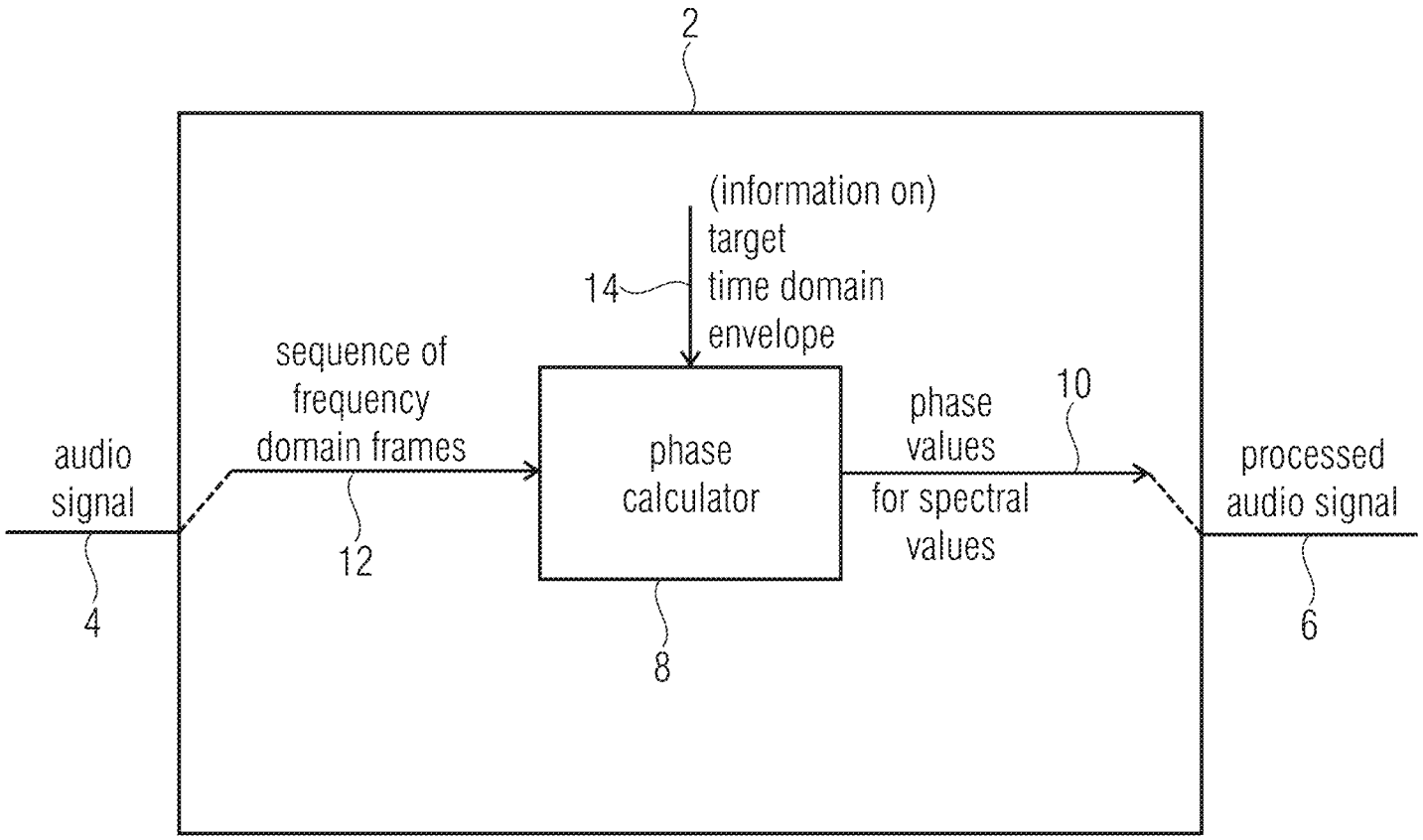
FIG. 1 shows a schematic block diagram of an apparatus for processing an audio signal to obtain a processed audio signal.

FIG. 1 shows a schematic block diagram of an apparatus 2 for processing an audio signal 4 to obtain a processed audio signal 6. The apparatus 2 comprises a phase calculator 8 for calculating phase values 10 for spectral values of a sequence of frequency-domain frames 12 representing overlapping frames of the audio signal 4. Moreover, the phase calculator 8 is configured to calculate the phase values 10 based on information on a target time-domain envelope 14 related to the processed audio signal 6, so that the processed audio signal 6 has at least in an approximation the target time-domain amplitude envelope 14 and a spectral envelope determined by the sequence of frequency-domain frames 12. Therefore, the phase calculator 8 may be configured to receive the information on the target time-domain envelope or to extract the information on the target time-domain envelope from (a representation of) the target time-domain envelope.

The spectral values of the sequence of frequency-domain frames 10 may be calculated using a Short-Time Fourier Transform (STFT) of the audio signal 4. Therefore, the STFT may use analysis windows having an overlapping range of, for example 50%, 67%, 75%, or even more. In other words, the STFT may use a hop size of, for example one half, one third, or one fourth of a length of the analysis window.

The information on the target time-domain envelope 14 may be derived using different or varying approaches related to the current or used embodiment. In a coding environment, for example, an encoder may analyze the (original) audio signal (before encoding) and transmit, for example, a codebook or lookup table index to the decoder representing a predefined target-domain envelope close to the calculated target-domain envelope. The decoder, having the same codebook or lookup table as the encoder may derive the target time-domain envelope using the received codebook index.

In a bandwidth enhancement environment, the envelope of the core-decoded representation of the audio signal may be a good approximation to the original target time-domain envelope.

Bandwidth enhancement covers any form of enhancing a bandwidth of a processed signal compared to the bandwidth of an input signal before processing. One way of bandwidth enhancement is a gap filling implementation, such as Intelligent Gap Filling as e.g. disclosed in WO2015010948 or semi-parametric gap filling, where spectral gaps in an input signal are filled or "enhanced" by other spectral portions of the input signal with or without the help of transmitted parametric information. A further way of bandwidth enhancement is spectral band replication (SBR) as used in HE-AAC (MPEG 4) or related procedures. where a band above a cross over frequency is generated by the processing. In contrast to the gap filling implementation, the bandwidth of the core signal in SBR is limited, while gap filling implementations have a full band core signal. Hence, the bandwidth enhancement represents a bandwidth extension to higher frequencies than a cross over frequency or a bandwidth extension to spectral gaps located, with respect to frequency, below a maximum frequency of the core signal.

Moreover, in a source separation environment, the target time-domain envelope may be approximated. This may be zero padding up to an initial position of a transient or using (different) onsets as an approximation or a rough estimate of the target time-domain envelope. In other words, an approximated target time-domain envelope may be derived from the current time-domain envelope of the intermediate time domain signal by forcing the current time-domain envelope to be zero from the beginning of the frame or part of the audio signal up to the initial position of a transient. According to further embodiments, the current time-domain envelope is (amplitude) modulated by one or more (predefined) onsets. The onset may be fixed for the (whole) processing of the audio signal or, in other words, chosen once before (or for) processing the first (time) frame or part of the audio signal.

The (approximation or estimation) of the target time-domain envelope may be used to form a shape of the processed audio signal, for example using amplitude modulation or multiplication, such that the processed audio signal has at least an approximation of the target time-domain envelope. However, the spectral envelope of the processed audio signal is determined by the sequence of frequency-domain frames, since the target time-domain envelope comprises mainly low frequency components when compared to the spectrum of the sequence of frequency-domain frames, such that the majority of frequencies remains unchanged.

Figure 2:
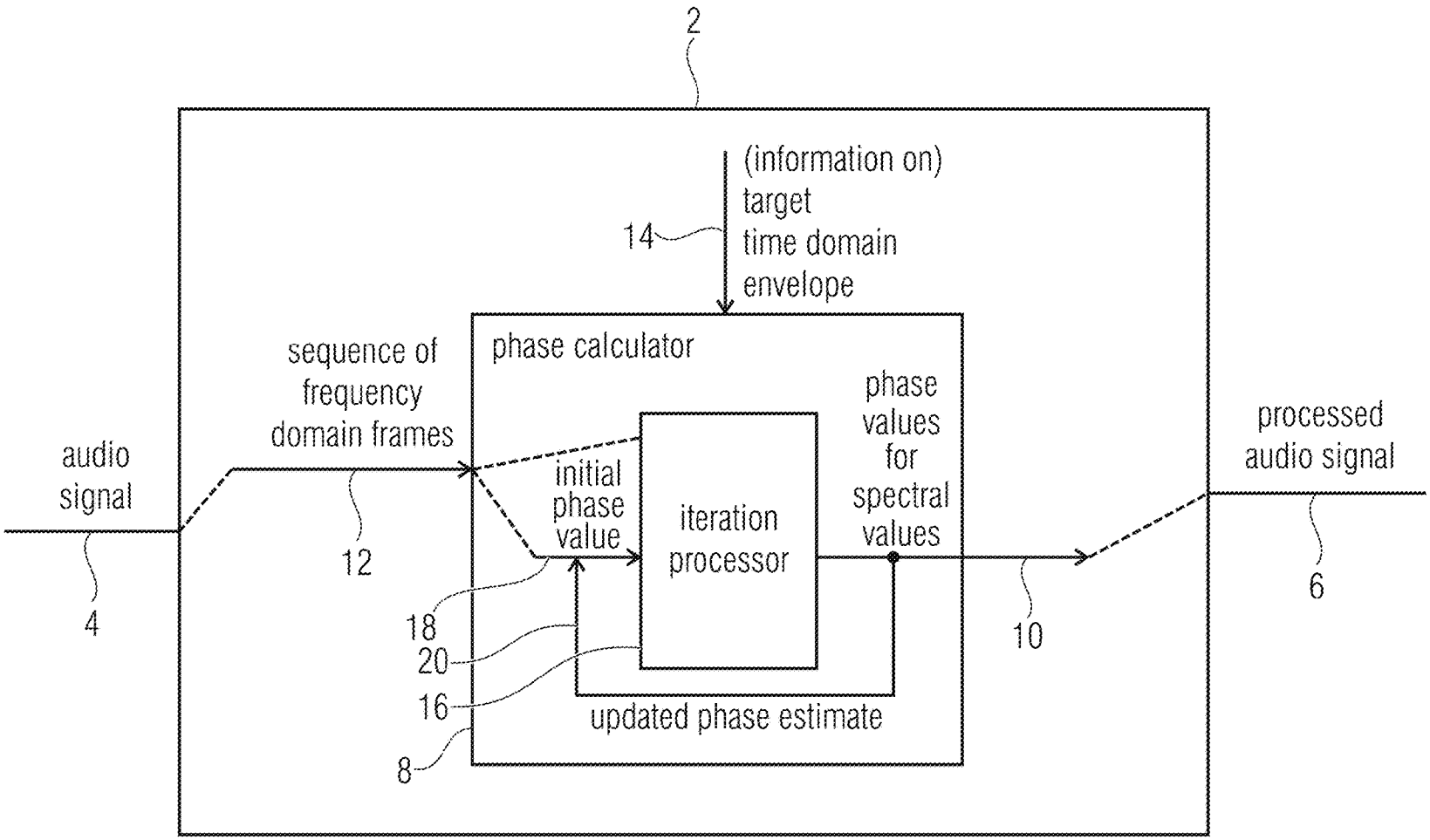
FIG. 2 shows a schematic block diagram of the apparatus according to a further embodiment using time-frequency-domain or frequency domain processing.

FIG. 2 shows a schematic block diagram of the apparatus 2 according to a further embodiment. The apparatus of FIG. 2 shows a phase calculator 8 comprising an iteration processor 16 for performing an iterative algorithm to calculate, starting from initial phase values 18, the phase values 10 for the spectral values using an optimization target entailing consistency of overlapping blocks in the overlapping range. Moreover, the iteration processor 16 is configured to use, in a further iteration step, an updated phase estimate 20, depending on the target time-domain envelope. In other words, the calculation of the phase values 10 may be performed using an iterative algorithm performed by the iteration processor 16. Therefore, magnitude values of the sequence of frequency-domain frames may be known and remain unchanged. Starting from the initial phase value 18, the iteration processor may iteratively update the phase values for the spectral values using, after each iteration, an updated phase estimate 20 to perform the iterations.

The optimization target may be e.g. a number of iterations. According to further embodiments, the optimization target may be a threshold, where the phase values are updated only to a minor extent when compared to the phase values of a previous iteration step, or the optimization target may be a difference of the (initial) constant magnitude of the sequence of frequency-domain frames when compared to the magnitude of the spectral values after an iteration process. Therefore, the phase values may be improved or upgraded such that an individual frequency spectrum of those parts of frames of the audio signal are equal or at least differ only to a minor extent. In other words, all frame portions of the overlapping frames of the audio signal overlapping one another should have the same or a similar frequency representation.

According to embodiments, the phase calculator is configured to perform the iterative algorithm in accordance with the iterative signal reconstruction procedure by Griffin and Lim. Further (more detailed) embodiments are shown with respect to the upcoming figures. Therein, the iteration processor will be subdivided or replaced by a sequence of processing blocks, namely the frequency-to-time converter 22, the amplitude modulator 24, and the time-to-frequency converter 26. For convenience, the iteration processor 16 is usually (not explicitly) pointed out in the further figures, however, the aforementioned processing blocks perform the same operations as the iteration processor 16, or, the iteration processor supervises or monitors the termination condition (or exit condition) of the iterative processing, such as e.g. the optimization target. Furthermore, the iteration processor may perform the operations according to a frequency-domain processing shown e.g. with respect to FIG. 4 and FIG. 7.

Figure 3:
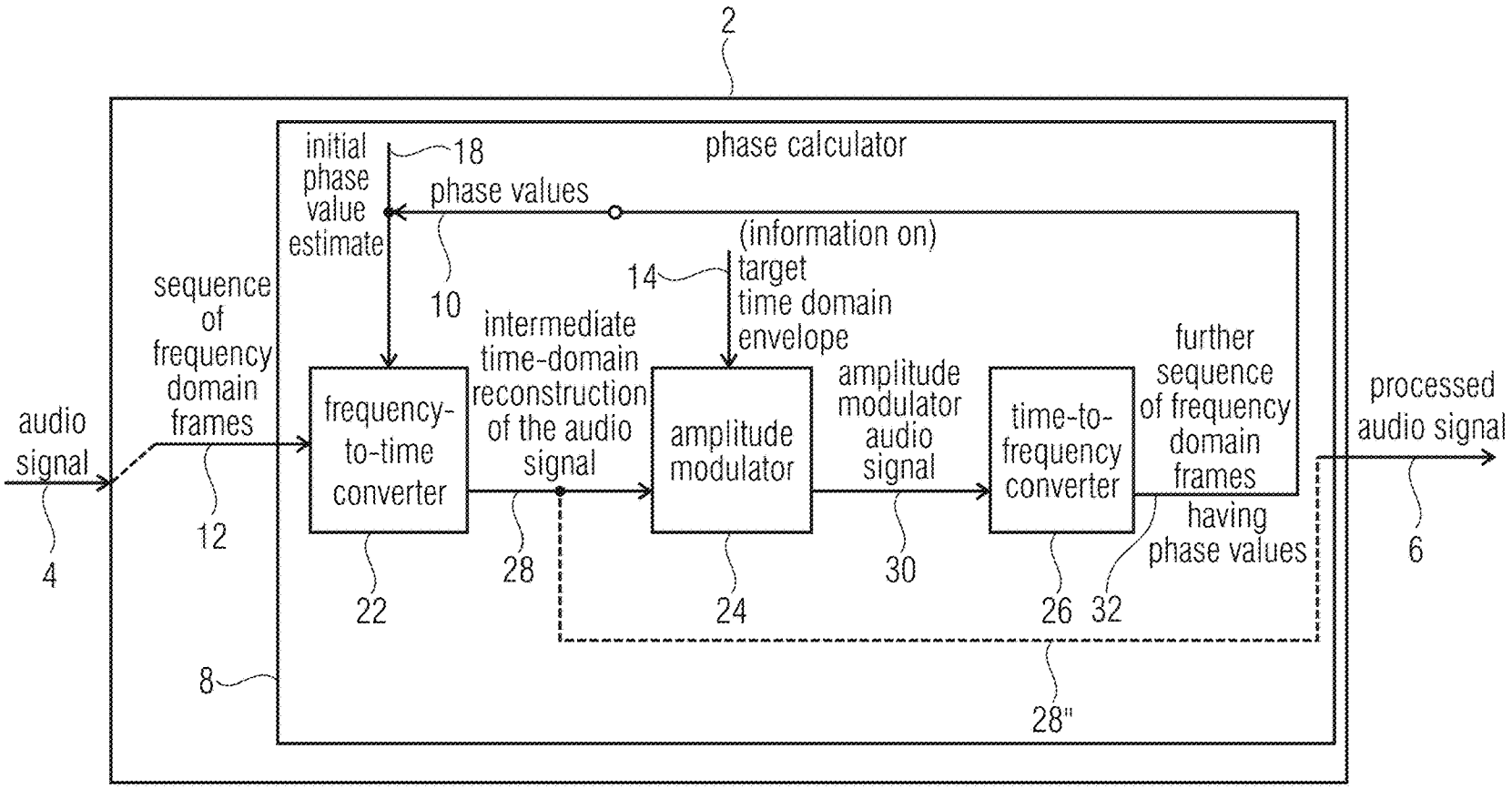
FIG. 3 shows the apparatus according to a further embodiment in a schematic block diagram using time-frequency-domain processing.

FIG. 3 shows the apparatus 2 according to a further embodiment in a schematic block diagram. The apparatus 2 comprises a frequency-to-time converter 22, an amplitude modulator 24, and a time-to-frequency converter 26, wherein the frequency-to-time conversion and/or the time-to-frequency conversion may perform an overlap-and-add procedure. The frequency-to-time converter 22 may calculate an intermediate time-domain reconstruction 28 of the audio signal 4 from the sequence of frequency-domain frames 12 and an initial phase value estimate 18 or phase value estimates 10 of a preceding iteration step. The amplitude modulator 24 may modulate the intermediate time-domain reconstruction 28 using the (information on) the target time-domain envelope 14 to obtain an amplitude modulated audio signal 30. Moreover, the time-to-frequency converter is configured to convert the amplitude modulated signal 30 into a further sequence of frequency-domain frames 32 having phase values 10. Therefore, the phase calculator 8 is configured to use, for a next iteration step, the phase values 10 (of the further sequence of frequency-domain frames) and the spectral values of the sequence of frequency-domain frames (which is not the further sequence of frequency-domain frames). In other words, the phase calculator uses updated phase values of the further sequence of frequency-domain frames 32 after each iteration step. Magnitude values of the further sequence of frequency-domain frames may be discarded or not used for further processing. Moreover, the phase calculator 8 uses magnitude values of the (initial) sequence of frequency-domain frames 12, since it is assumed that the magnitude values are already (perfectly) reconstructed.

More general, the phase calculator 8 is configured to apply an amplitude modulation, for example in the amplitude modulator 22, to an intermediate time-domain reconstruction 28 of the audio signal 4, based on the target time-domain envelope 14. The amplitude modulation may be performed using single-sideband modulation, double-sideband modulation with or without suppressed-carrier transmission or using a multiplication of the target time-domain envelope with the intermediate time-domain reconstruction of the audio signal. The initial phase value estimate may be a phase value of the audio signal, a (arbitrary) chosen value such as, for example, zero, a random value, or an estimate of a phase of a frequency band of the audio signal, or a phase of a source of the audio signal, for example when using audio source separation.

According to further embodiments, the phase calculator 8 is configured to output the intermediate time-domain reconstruction 28 of the audio signal 4 as the processed audio signal 6, when an iteration determination condition (e.g. iteration termination condition) is fulfilled. The iteration determination condition may be closely related to the optimization target and may define a maximum deviation of the optimization target to a current optimization value. Moreover, the iteration determination condition may be a (maximum) number of iterations, a (maximum) deviation of a magnitude of the further sequence of frequency-domain frames 32 when compared to the magnitude of the sequence of frequency-domain frames 12, or a (maximum) update effort of the phase values 10, between a current and a previous frame.

Figure 4:
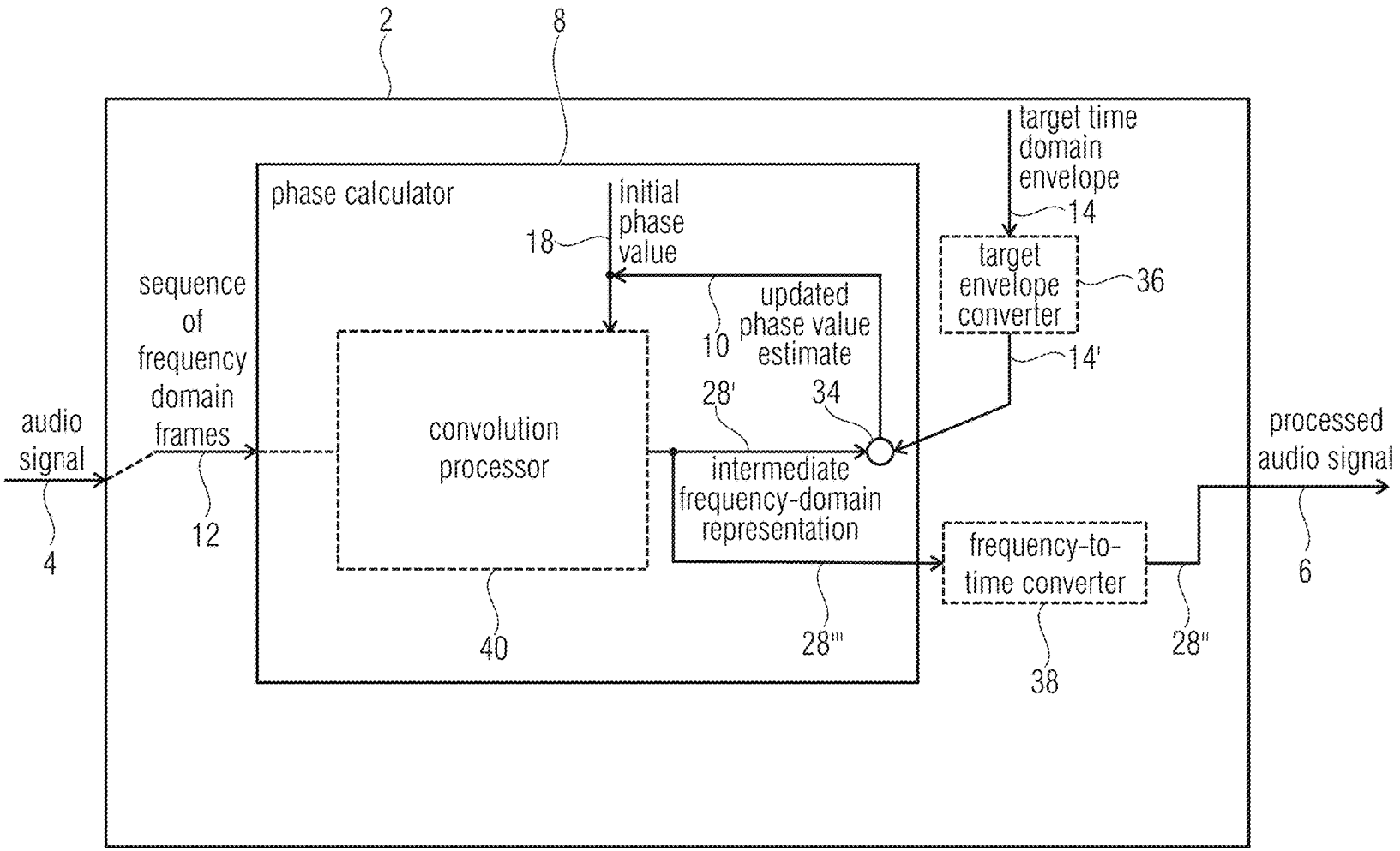
FIG. 4 shows a schematic block diagram of the apparatus according to an embodiment using frequency domain processing.

FIG. 4 shows a schematic block diagram of the apparatus 2 according to an embodiment, which may be an alternative embodiment when compared to the embodiment of FIG. 3. The phase calculator 8 is configured to apply a convolution 34 of a spectral representation 14' of at least one target time-domain envelope 14 and at least one intermediate frequency-domain representation, or selected parts or bands or only a high-pass portion or only several bandpass portions of the at least one target time-domain envelope 14 or at least one intermediate frequency-domain representation 28' of the audio signal 4. In other words, the processing of FIG. 3 may be performed in frequency-domain instead of time-domain. Therefore, the target time-domain envelope 14, more specifically, a frequency representation 14' thereof, may be applied to the intermediate frequency-domain representation 28' using convolution instead of amplitude modulation. However, the idea is again to use the (original) magnitude of the sequence of frequency-domain frames for each iteration and furthermore, after using the initial phase value 18 in a first iteration step, using updated phase value estimates 10 for each further iteration step. In other words, the phase calculator is configured to use phase values 10 obtained by the convolution 34 as updated phase value estimates for the next iteration step. Moreover, the apparatus may comprise a target envelope converter 36 for converting the target time-domain envelope into the spectral domain. Furthermore, the apparatus 2 may comprise a frequency-to-time converter 38 for calculating the time-domain reconstruction 28 from the intermediate frequency-domain reconstruction 28' using the phase value estimates 10 obtained from a most recent iteration step and the sequence of frequency-domain frames 12. In other words, the intermediate frequency-domain representation 28' may comprise magnitude values of the sequence of frequency-domain frames and a phase value 10 of the updated phase value estimates. The time-domain reconstruction 28 may be the processed audio signal 6 or at least a portion of the processed audio signal 6. The portion may relate, for example, to a reduced number of frequency-bands when compared to a total number of frequency bands of the processed audio signal or the audio signal 4.

According to further embodiments, the phase calculator 8 comprises a convolution processor 40. The convolution processor 40 may apply a convolution kernel, a shift kernel, and/or an add-to-center frame operation to obtain the intermediate frequency-domain representation 28' of the audio signal 4. In other words, the convolution processor may process the sequence of frequency-domain frames 12, wherein the convolution processor 40 may be configured to apply a frequency-domain equivalent of a time-domain overlap-and-add procedure to the sequence of frequency-domain frames 12 in the frequency-domain to determine the intermediate frequency-domain reconstruction. According to further embodiments, the convolution processor is configured to determine, based on a current frequency-domain frame, a portion of adjacent frequency-domain frames which contributes to the current frequency-domain frame after time-domain overlap-and-add is performed in the frequency-domain. Moreover, the convolution processor 40 may further determine an overlapping position of the portion of the adjacent frequency-domain frame within the current frequency-domain frame and to perform an addition of the positions of adjacent frequency-domain frames with the current frequency-domain frame at the overlapping position. According to a further embodiment, the convolution processor 40 is configured to time-to-frequency transform a time-domain synthesis and a time-domain analysis window to determine a portion of an adjacent frequency-domain frame, which contributes to the current frequency-domain frame after time-domain overlap-and-add is performed in the frequency-domain. Moreover, the convolution processor is further configured to shift the portion of the adjacent frequency-domain frame to an overlapping position within the current frequency-domain frame and to apply the portion of the adjacent frequency-domain frame to the current frame at the overlapping position.

In other words, the time-domain procedure shown in FIG. 3 may be transferred (transformed, applied or converted) to the frequency-domain. Therefore, the synthesis and analysis windows of the frequency-to-time converter 22 and the time-to-frequency converter 26 may be transferred (transformed, applied or converted) to the frequency-domain. The (resulting) frequency-domain representation of the synthesis and analysis windows determines (or cuts out) portions of adjacent frames to a current frame which would have been overlapping in an overlap-and-add procedure in the time-domain. Moreover, the cut portions are shifted to a correct position within the current frame and added to the current frame such that the time-domain frequency-to-time transform and the time-to-frequency transform are performed in the frequency-domain. This is advantageous, since an explicit signal transformation may be neglected or not performed, which may increase the computational efficiency of the phase calculator 8 and the apparatus 2.

Figure 5:
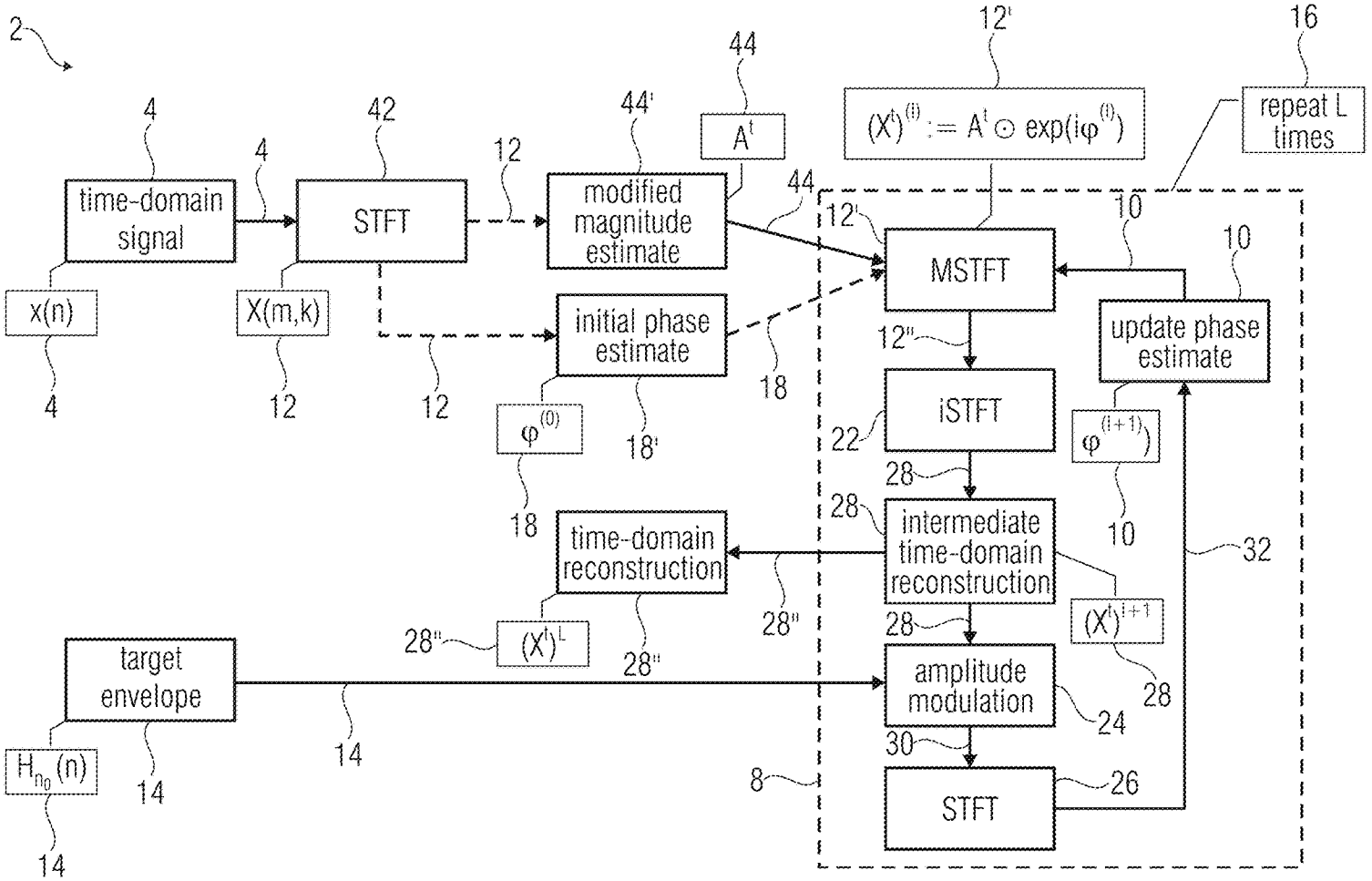
FIG. 5 shows a schematic block diagram of the apparatus according to a further embodiment using time-frequency domain processing.

FIG. 5 shows a schematic block diagram of the apparatus 2 according to a further embodiment focusing on signal reconstruction of separated channels or bands of the audio signal 4. Therefore, the audio signal 4 in time-domain may be transformed to the sequence of frequency-domain frames 12 representing overlapping frames of the audio signal 4 using a time-frequency converter, for example an STFT 42. Thereof, a modified magnitude estimator 44' may derive a magnitude 44 of the sequence of frequency-domain frames or components or component signals of the sequence of frequency-domain frames. Moreover, an initial phase estimate 18 may be calculated from the sequence of frequency-domain frames 12 using an initial phase estimator 18' or the initial phase estimator 18' may choose, for example, an arbitrary phase estimate 18, which is not derived from the sequence of frequency-domain frames 12. Based on the magnitude 44 of the sequence of frequency-domain frames 12 and the initial phase estimate 18, an MSTFT 12' may be calculated as an initial sequence of frequency-domain frames 12" having a (perfectly) reconstructed magnitude 44 which remains unchanged in the further processing, and only an initial phase estimate 18. The initial phase estimate 18 is updated using the phase calculator 8.

In a further step, the frequency-to-time converter 22, for example an inverse STFT (ISTFT), may calculate the intermediate time-domain reconstruction 28 of the (initial) sequence of frequency-domain frames 12". The intermediate time-domain reconstruction 28 may be amplitude-modulated, for example multiplied, with a target envelope, or more precise, the target time-domain envelope 14. The time-to-frequency converter 26, for example an STFT, may calculate the further sequence of frequency-domain frames 32 having phase values 10. The MSTFT 12' may use the updated phase estimator 10 and the magnitude 44 of the sequence of frequency-domain frames 12 in an updated sequence of frequency-domain frames. This iterative algorithm may be performed or repeated L times within, for example, the iteration processor 16, which may perform the aforementioned processing steps of the phase calculator 8. E.g. after the iteration process is completed, the time domain reconstruction 28" is derived from the intermediate time domain reconstruction 28.

In other words, in the following, the notation and signal model is shown and the employed signal reconstruction method is described. Afterwards, an extension for transient preservation in the LSEE-MSTFTM method is shown in connection with an illustrative example.

The real-valued, discrete time-domain signal $x:\mathbb{Z}\rightarrow\mathbb{R}$ is considered to be a mixture of concurrent component signals. An objective is to decompose x into a transient target signal $x^t:\mathbb{Z}\rightarrow\mathbb{R}$ and a residual component signal $x^r:\mathbb{Z}\rightarrow\mathbb{R}$ such that $$x\approx x^t+x^r. \tag{1'}$$

Note that the decomposition is posed as an approximation, since the focusing is on improved perceptual quality of the transient signal $x^t$ and it is accepted that the superposition of $x^t$ and $x^r$ might not exactly yield the original X. For the moment, it is assumed that $x^t$ contains precisely one transient, whose temporal position $n_0\in\mathbb{Z}$ is known. Let $\chi(m,k)$ with m, $k\in\mathbb{Z}$ be a complex-valued TF bin at the $m^{th}$ time frame and $k^{th}$ spectral coefficient of a Short-Time Fourier Transform (STFT). The coefficient is computed by $$\mathcal{X}(m,k):=\sum_{n=0}^{N-1}x(n+\mathrm{mH})w(n)\exp(-2\pi ikn/N), \tag{2'}$$

where $w:[0:N-1]\rightarrow\mathbb{R}$ is a suitable window function of block size $N\in\mathbb{N}$ and $H\in\mathbb{N}$ is the hop size parameter. For simplicity, it can be also written $\chi=\mathrm{STFT}(x)$. From $\chi$, the magnitude spectrogram $\mathcal{A}$ and the phase spectrogram $\varphi$ are derived as:

$$\mathcal{A}(m,k):=|\chi(m,k)|, \tag{3'}$$

$$\varphi(m,k):=\angle\chi(m,k) \tag{4'}$$

with $\varphi(m,k)\in[0,2\pi)$. It is assumed that, through some suitable source separation procedure, estimating a modified STFT (MSTFT) $\chi^t$ is possible, which represents the transient component signal. More specifically, it is set $\chi^t:=\mathcal{A}^t\odot\exp(i\varphi^t)$, where $\mathcal{A}^t$ and $\varphi_t$ are estimates of the magnitude, resp. phase spectrogram, and the operator $\odot$ denotes element-wise multiplication. The time domain reconstruction of $\chi^t$ is achieved by first applying the inverse Discrete Fourier Transform (DFT) to each spectral frame, yielding a set of intermediate time signals $y_m$, $m\in\mathbb{Z}$ defined by $$y_m(n):=\frac{1}{N}\sum_{k=0}^{N-1}\mathcal{X}^t(m,k)\exp(2\pi ikn/N), \tag{5'}$$

for $n\in[0:N-1]$ and $y_m(n):=0$ for $n\in\mathbb{Z}\setminus[0:N-1]$. Second, the least squares error reconstruction method as $$x^t(n):=\frac{\sum_{m\in\mathbb{Z}}y_m(n-\mathrm{mH})w(n-\mathrm{mH})}{\sum_{m\in\mathbb{Z}}w(n-\mathrm{mH})^2}, \tag{6'}$$

$n\in\mathbb{Z}$ is applied, where the analysis window $w$ is reused as synthesis window. For simplicity, this procedure is denoted as $x^t:=\mathrm{iSTFT}(\chi^t)$ (referred to as LSEE-MSTFT in [8]).

Since the estimate for $\chi^t$ is obtained in the TF (time-frequency) domain, it cannot be assumed that $x^t$ is a consistent signal. In practice, it is likely to encounter transient smearing and pre-echos in $x^t$. This is especially true for large N. To remedy this problem, iteratively refining $\chi^t$ by the following procedure is proposed, where the iteration index $l=0, 1, 2, \ldots L\in\mathbb{N}$ is introduced and a the given transient location $n_0$ is used. Given $\mathcal{A}^t$ and the initial $\varphi_{(0)}$, the initial MSTFT estimate of the transient signal component is introduced as $(\chi^t)^{(0)}:=\mathcal{A}_t\odot\exp(i\varphi_{(0)})$ and the following steps are repeated for $l=0, 1, 2, \ldots L$ 1. $(x^t)^{(l+1)}:=\mathrm{iSTFT}((\chi^t)^{(l)})$ via (5') and (6')
2. Enforce $(x^t)^{(l+1)}(n):=0$ for $n\in\mathbb{Z}$, $n<n_0$
3. $\varphi^{(l+1)}:=\angle\mathrm{STFT}((x^t)^{(l+1)})$ via (2') and (4')
4. $(\chi^t)^{(l+1)}:=\mathcal{A}^t\odot\exp(i\varphi^{(l+1)})$ The embodiment of FIG. 5 may be described more general, using component signals indicated with $\mathcal{A}_c$ instead of the earlier described transient signals indicated with $\mathcal{A}^t$. In general, with respect to all described embodiments, signals indicated by a subscript c may be replaced by the signal the corresponding signal indicated by a superscript t and the other way round. Subscript c denotes a component signal wherein superscript t denotes a transient signal, which may be a component signal. Nonetheless, a signal having superscript t may be as well replaced by (the more general) signal having subscript c. The embodiments described with respect to transient signals are not limited to transient signal and may be therefore applied to any other component signal. E.g. $\mathcal{A}^t$ may be replaced by $\mathcal{A}_c$ and vice versa.

Figures 10A, 10B:
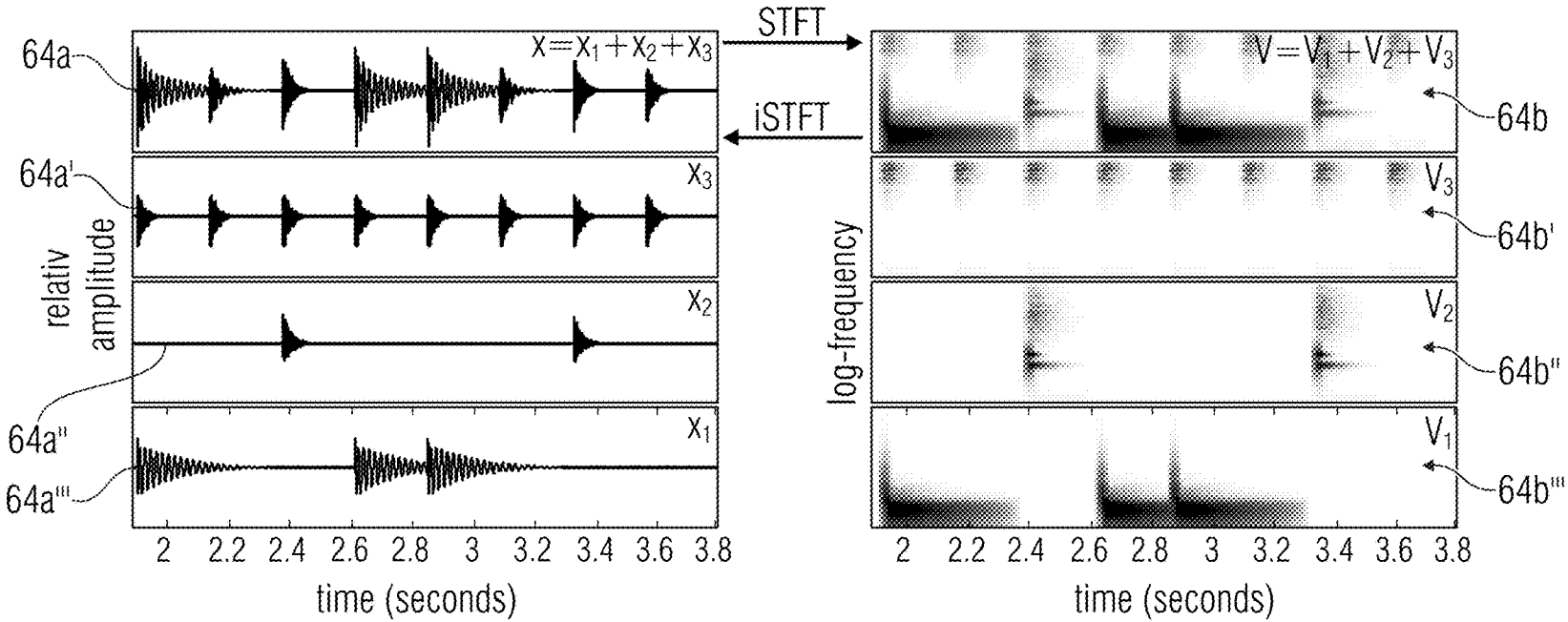
FIG. 10*a-b* show a schematic illustration of a percussive signal mixture containing three instruments as sources for source-separation of drum loops.

Therefore, the real-valued, discrete time-domain signal $x:\mathbb{Z}\rightarrow\mathbb{R}$ is considered to be a linear mixture $x:=\Sigma_{c=1}^{C}x_c$ of $C\in\mathbb{N}$ component signals $x_c$ corresponding to individual sources (e.g. instruments). As shown in FIG. 10*a*, each component signal contains at least one transient audio event produced by the corresponding instrument (in the present example case, by striking a drum). Furthermore, it is assumed that a symbolic transcription is available that specifies the onset time (i.e., transient position) and instrument type for each of the audio events. From that transcription, the total number of onset events S is derived as well as the number of unique instruments C. An aim is to extract individual component signals $x_c$ from the mixture x as shown in FIG. 10. For evaluation purposes, having the "oracle" (i.e. true) component signals $x_c$ available is assumed. x is decomposed in the TF-domain, to this end STFT is employed as follows. Let $\chi(m,k)$ be a complex-valued TF coefficient at the $m^{th}$ time frame and $k^{th}$ spectral bin. The coefficient is computed by $$\mathcal{X}(m,k):=\sum_{n=0}^{N-1}x(n+\mathrm{mH})w(n)\exp(-2\pi ikn/N), \tag{1}$$

where $w:[0:N-1]\rightarrow\mathbb{R}$ is a suitable window function of block size $N\in\mathbb{N}$, and $H\in\mathbb{N}$ is the hop size parameter. The number of frequency bins is K=N/2 and the number of spectral frames M∈[1:M] is determined by the available signal samples. For simplicity, it may be written $\chi$=STFT(x). Following [2], $\chi$ is called a consistent STFT since it is a set of complex numbers which has been obtained from the real time-domain signal x via (1). In contrast, an inconsistent STFT is a set of complex numbers that was not obtained from a real time-domain signal. From $\chi$, the magnitude spectrogram $\mathcal{A}$ and the phase spectrogram $\varphi$ are derived as $$\mathcal{A}(m,k):=|\chi(m,k)|. \tag{2}$$

$$\varphi(m,k):=\angle\chi(m,k), \tag{3}$$

with $\varphi(m,k)\in[0,2\pi)$.

Let $V:=\mathcal{A}^T\in\mathbb{R}_{\geq 0}^{K\times M}$ be a non-negative matrix holding a transposed version of the mixture's magnitude spectrogram $\mathcal{A}$. An objective is to decompose V into component magnitude spectrograms $V_c$ that correspond to the distinct instruments as shown in FIG. 10*b*. For the moment, it is assumed that some oracle estimator extracts the desired $\mathcal{A}_c:=V_c^T$. One possible approach to estimate the component magnitudes using a state-of-the-art decomposition technique will be described later. In order to reconstruct a specific component signal $x_c$, we set $\chi_c:=\mathcal{A}_c\odot\exp(i\varphi_c)$, where $\mathcal{A}_c=V_c^T$ and $\varphi_c$ is an estimate of the component phase spectrogram. It is common practice to use the mixture phase information $\varphi$ as an estimate for $\varphi_c$ and to invert the resulting MSTFT via the LSEE-MSTFT reconstruction method from [1]. The method first applies the inverse Discrete Fourier Transform (DFT) to each spectral frame in $\chi_c$, yielding a set of intermediate time signals $y_m$, with m∈[0:M−1], defined by $$y_m(n):=\frac{1}{N}\sum_{k=0}^{N-1}\mathcal{X}_c(m,k)\exp(2\pi ikn/N), \tag{4}$$

for n∈[0:N−1] and $y_m(n):=0$ for $n\in\mathbb{Z}\setminus[0:N-1]$. Second, the least squares error reconstruction is achieved by $$x_c(n):=\frac{\sum_{m\in\mathbb{Z}} y_m(n-\mathrm{mH})w(n-\mathrm{mH})}{\sum_{m\in\mathbb{Z}} w(n-\mathrm{mH})^2}, \tag{5}$$

$n\in\mathbb{Z}$, where the analysis window w is reused as synthesis window. For simplicity, this procedure is denoted as $x_c$=iSTFT($\chi_c$) (referred to as LSEE-MSTFT in [1]).

Since the MSTFT $\chi_c$ is constructed in the TF domain, it has to be assumed that it may be an inconsistent STFT, i.e., there may not exist a real time-domain signal $x_c$ fulfilling $\chi_c$=STFT($x_c$). Intuitively speaking, the complex interplay between magnitude and phase is likely corrupted as soon as the magnitude in certain TF bins is modified. In practice, this inconsistency can lead to transient smearing and pre-echos in $x_c$, especially for large N.

To remedy this problem, it is proposed to iteratively minimize the inconsistency of $\chi_c$ by the following extension of the LSEE-MSTFTM procedure [1]. For the moment, it may be assumed that $\chi_c$ contains precisely one transient onset event, whose exact location in time $n_0$ is known. Now, the iteration index l=0, 1, 2, . . . L∈ℕ is introduced. Given $A_c$ and some initial phase estimate $(\varphi_c)^{(0)}$. the initial STFT estimate of the target component signal $(\chi_c)^{(0)}:=\mathcal{A}_c\odot\exp(i)\varphi_c)^{(0)}$ is introduced and the following steps are repeated for l=0, 1, 2, . . . L.

1. $(x_c)^{(l+1)}:=\mathrm{iSTFT}((\chi_c)^{(l)})$ via (4) and (5)
2. Enforce $(x_c)^{(l+1)}(n):=0$ for $n\in\mathbb{Z}$, $n<n_0$
3. $(\varphi_c)^{(l+1)}:=\angle\mathrm{STF}((x_c)^{(l+1)})$ via (1) and (3)
4. $(\chi_c)^{(l+1)}:=\mathcal{A}_c\odot\exp(i(\varphi_c)^{(l+1)})$ According to embodiments, an advantageous point of the described methods, encoder or decoder is the intermediate step 2, which enforces transient constraints in the LSEE-MSTFTM procedure.

Figure 6A:
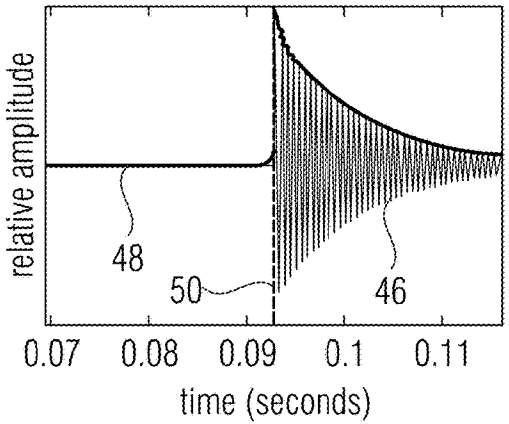
FIG. 6*a-d* show a schematic plot of the transient restoration according to an embodiment.
Figure 6B:
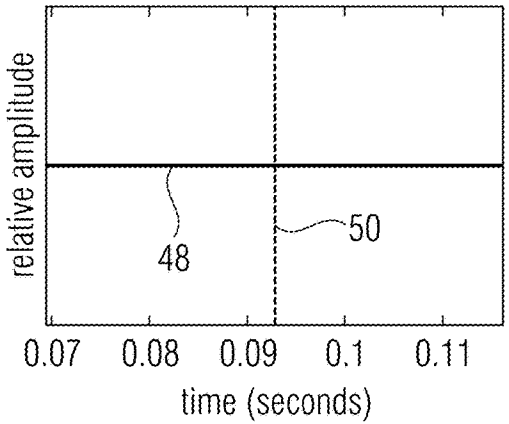
Figure 6C:
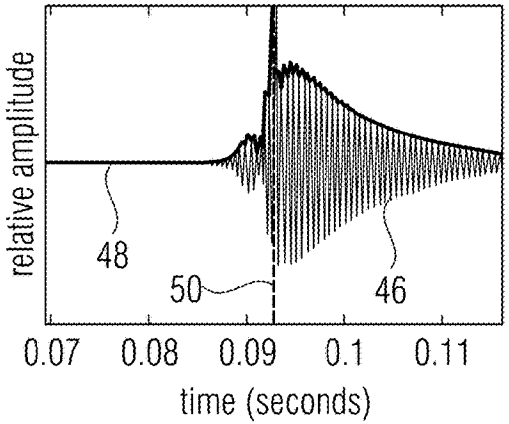
Figure 6D:
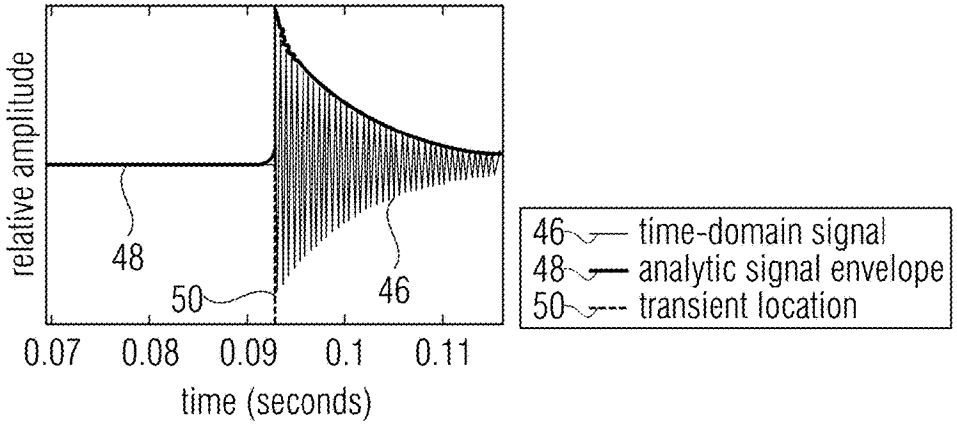

FIG. 6*a-d* show a schematic plot of the transient restoration according to an embodiment indicating a time-domain signal 46, an analytic signal envelope 48, and a transient location 50. FIG. 6 illustrates the proposed method or apparatus with the target component signal 46, overlaid with the envelope of its analytic signal 48 in FIG. 6*a*. The example signal exhibits transient behavior or transient signal component around $n_0$ 50 when the waveform transitions from silence to an exponentially decaying sinusoid or sinewave. FIG. 6*b* shows the time-domain reconstruction obtained from the iSTFT with $(\varphi_c)^{(0)}=0$ (i.e., zero phase for all TF bins). Through destructive interference of overlapping frames, the transient is completely destroyed, the amplitude of the sinusoid is strongly decreased and the envelope looks nearly flat. FIG. 6*c* shows the reconstruction with pronounced transient smearing after L=200 LSEE-MSTFTM iterations. FIG. 6*d* shows that the restored transient after L=200 iterations of the proposed method is much closer to the original signal. Small ripples are visible in the envelope ahead of $n_0$, but overall the restoration is much closer to the original signal. In real-world recordings, there usually exist multiple transient onsets event throughout the signal. In this case, one may apply the proposed method to signal excerpts localized between consecutive transients (resp. onsets) as shown in FIG. 9.

Figure 7:
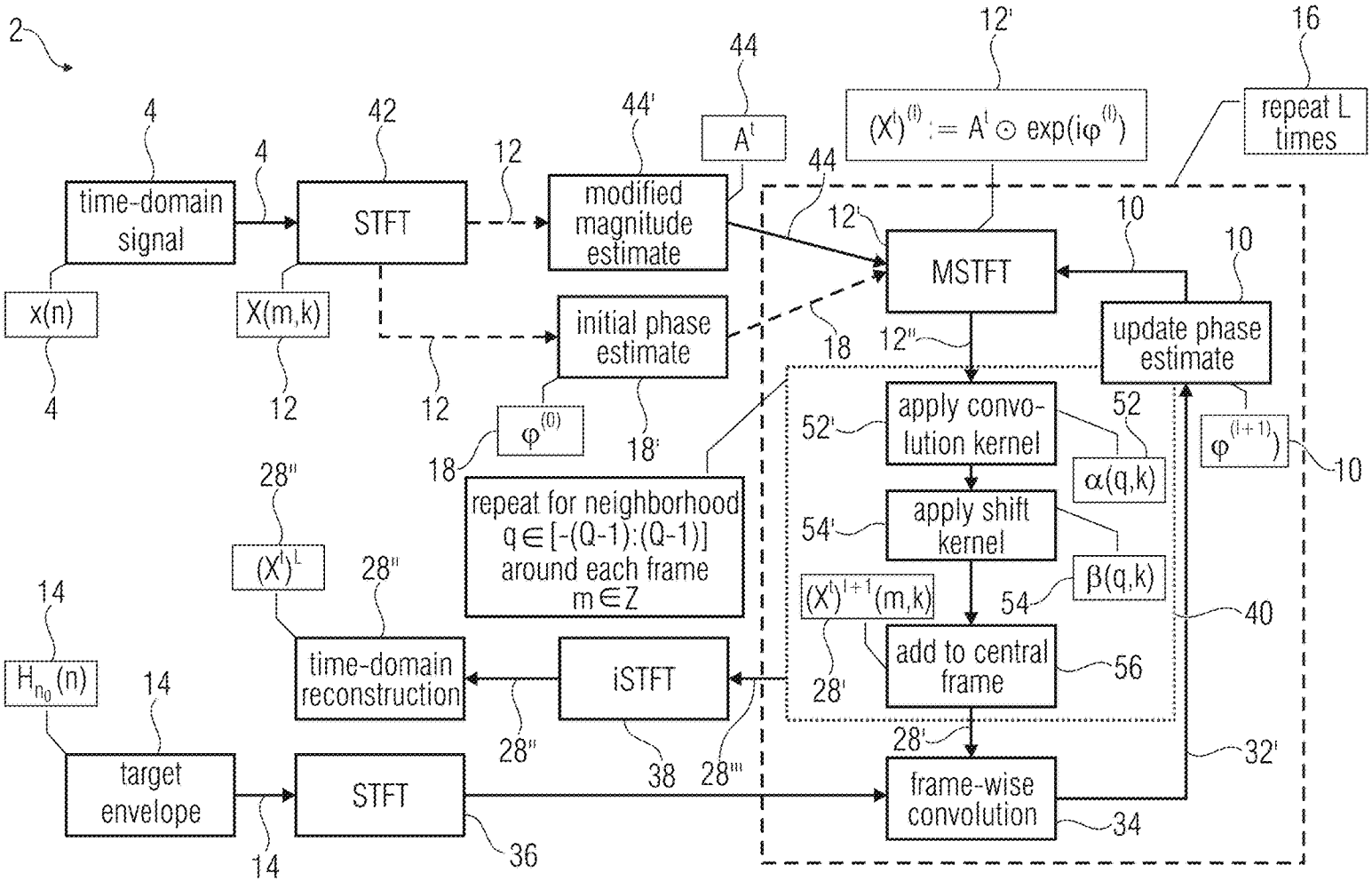
FIG. 7 shows a schematic block diagram of the apparatus according to a further embodiment using frequency-domain processing.

FIG. 7 shows a schematic block diagram of the apparatus 2 according to a further embodiment. Similar to FIG. 4, the phase calculator performs the phase calculation in the frequency-domain. The frequency-domain processing may be equal to the time-domain processing described with respect to the embodiment shown in FIG. 5. Again, the time-domain signal 4 may be time-frequency transformed using the STFT (performer) 42 to derive the sequence of frequency-domain frames 12. Thereof, a modified magnitude estimator 44' may derive the modified magnitude 44 from the sequence of frequency-domain frames 12. The initial phase estimator 18' may derive the initial phase estimate 18 from the sequence of frequency-domain frames or it may provide, for example, an arbitrary initial phase estimate. Using the modified magnitude estimate and the initial phase estimate, the MSTFT 12' calculates or determines the initial sequence of frequency-domain frames 12", which will receive updated phase values after each iteration step. Different to embodiments of FIG. 5 is the (initial) sequence of frequency-domain frames 12" in the phase calculator 8. Based on time-domain synthesis and analysis windows, for example, the synthesis and analysis window used in the ISTFT 22 or the STFT 26 in FIG. 5, a convolution kernel calculator 52' may calculate the convolution kernel 52 using a frequency-domain representation of the synthesis and analysis windows. The convolution kernel cuts out (slices out or uses) parts of neighboring or adjacent frames of a current frequency-domain frame that would overlap the current frame using overlap-and-add in the ISTFT 22. A kernel shift calculator 54' may calculate a shift kernel 52 and apply the shift kernel 52 to the parts of the adjacent frequency-domain frames to shift those parts to a correct overlapping position of a current frequency-domain frame. This may emulate the overlapping operation of the overlap-and-add procedure of the ISTFT 22. Moreover, block 56 performs the addition of the overlap-and-add procedure and adds the overlapping parts of the adjacent frames to the central frame period. The convolution kernel calculation and application, the shift kernel calculation and application, and the addition in block 56 may be performed in the convolution processor 40. The output of the convolution processor 40 may be an intermediate frequency-domain reconstruction 28' of the sequence of frequency-domain frames 12 or the initial sequence of frequency-domain frames 12". The intermediate frequency-domain reconstruction 28' may be (frame-wise) convolved with a frequency-domain representation of the target envelope 14 using the convolution 34. The output of the convolution 34 may be the further sequence of frequency-domain frames 32' having phase values 10. The phase values 10 replace the initial phase estimate 18 in the MSTFT 12' in the further iteration step. The iteration may be performed L times using the iteration processor 15. After the iteration process is stopped, or at a certain point of time within the iteration process, a final frequency-domain reconstruction 28''' may be derived from the convolution processor 40. The final frequency-domain reconstruction 28''' may be the intermediate frequency-domain reconstruction 28' of a most recent iteration step. Using a frequency-to-time converter 38, for example an ISTFT, the time-domain reconstruction 28" may be obtained, which may be the processed audio signal 6.

In other words, it is advantageous to apply an intermediate step in the LSEE-MSTFTM iteration. It may enforce all samples ahead of the transient to be zero before computing the STFT again to obtain an updated estimate of the phases $\varphi^{(l+1)}$. This constraint can also be enforced directly in the TF domain. Therefore, setting some pre-requisites may be advantageous. First, the normalization to the sum of the time-shifted and squared window functions in the denominator of (6) can be omitted by imposing certain constraints on w and H (e.g., using a symmetric Hann window and entailing the redundancy Q=N/H to be radix 4 [2]). The number of unique (up to conjugation) spectral bins per frame is K=N/2, and the frequency argument is evaluated for k∈[−K:K]. Focusing for the moment on a single spectral frame, the operation of successively applying iSTFT and STFT again can be expressed in the TF domain as a superposition of weighted spectral contributions from the preceding and subsequent frames. Only frames that overlap with the central one need to be considered. This is expressed by a neighborhood frame index q∈[−Q−1):(Q−1)]. Two TF kernels are constructed, the first one being a convolution kernel $$\alpha(q,k) := \frac{1}{N}\sum_{n=0}^{N-1} w(n)w(n+qH)\exp(-2\pi ikn/N), \tag{7'}$$

that captures the DFT of the element-wise product of the synthesis window with a truncated and time-shifted version of the analysis window. The second kernel is a multiplicative one $$\beta(q,k) := \exp(2\pi ik(-q/Q)), \tag{8'}$$

that is needed to shift the contribution from neighboring frames to the correct position inside the central frame. The kernels are applied to each TF bin in succession $$(\mathcal{X}^t(m,k))^{(l+1)} := \sum_{q=-(Q-1)}^{Q-1} \beta(q,k) \sum_{p=-K}^{K} \alpha(q,p)(\mathcal{X}^t(m,k+p))^{(l)} \tag{9'}$$

Now the proposed transient restoration can be included in a straightforward manner by a second convolution operation that only needs to be applied to the frames in which $n_0$ is located. The corresponding convolution kernels can be taken frame-wise from the STFT of an appropriately shifted Heavyside function $$\mathcal{H}_{n_0}(n) := \begin{cases} 0, & n < n_0, \\ 1, & n \geq n_0, \end{cases} \tag{10'}$$

Note, that in addition to using this step shaped function, it is proposed to use the STFT of arbitrarily shaped envelope time-domain amplitude envelope signals. It is stated that a wide range of reconstruction constraints can be imposed through appropriate signal modulation in the time domain, respective convolution in the TF domain.

As shown in [4], the computational load of applying the frequency domain operators can be reduced by truncating the convolution kernel α to a smaller number of central coefficients. This is heuristically motivated by the observation, that the most pronounced coefficients are located around k=0. Experiments have shown that the TF reconstruction is still very close to the time-domain reconstruction if α is truncated in frequency direction to k∈[−3: +3]. In addition, α is Hermitian, if the window functions are appropriately chosen. Based on these conjugate complex symmetries, complex multiplications and therefore processing power, may be spared. Furthermore, it is not necessary to consider a phase update of each frequency bin. Instead, one can select a fraction of the bins that exhibit the highest magnitude, and apply (9') only to those, since they will dominate the reconstruction. As will be shown, a reasonable first guess for the phase information will also help to speed up the convergence of the reconstruction.

For evaluation, the conventional LSEE-MSTFTM (denoted as GL) reconstruction is compared with the proposed method (denoted as TR) under two different initialization strategies for $(\chi^t)^{(0)}$. In the following, the used dataset, the test item generation, and the used evaluation metrics are described.

In all experiments, publicly available "IDMT-SMT-Drums" dataset is used. In the "WaveDrum02" subset, there are 60 drum loops, each given as perfectly isolated single track recordings (i.e., oracle component signals) of the three instruments kick drum, snare drum, and hi-hat. All 3×60 recordings are in uncompressed PCM WAV format with 44:1 kHz sampling rate, 16 Bit, mono. Mixing all three single tracks together, 60 mixture signals are obtained. Additionally, the onset times and thus the approximate $n_0$ of all onsets are available per individual instrument. Using this information, a test set of 4421 drum onset events is constructed by taking excerpts from the mixtures, each located between consecutive onsets of the target instrument. In doing so, N samples ahead of each excerpt are zero padded. The rationale is to deliberately prepend a section of silence in front of the local transient position. Inside that section, decay influence of preceding note onsets can be ruled out and potentially occurring pre-echos can be measured. In turn, this leads to a virtual shift of the local transient location to $n_0+N$ (which is denoted again as $n_0$ for notational convenience).

Figure 8:
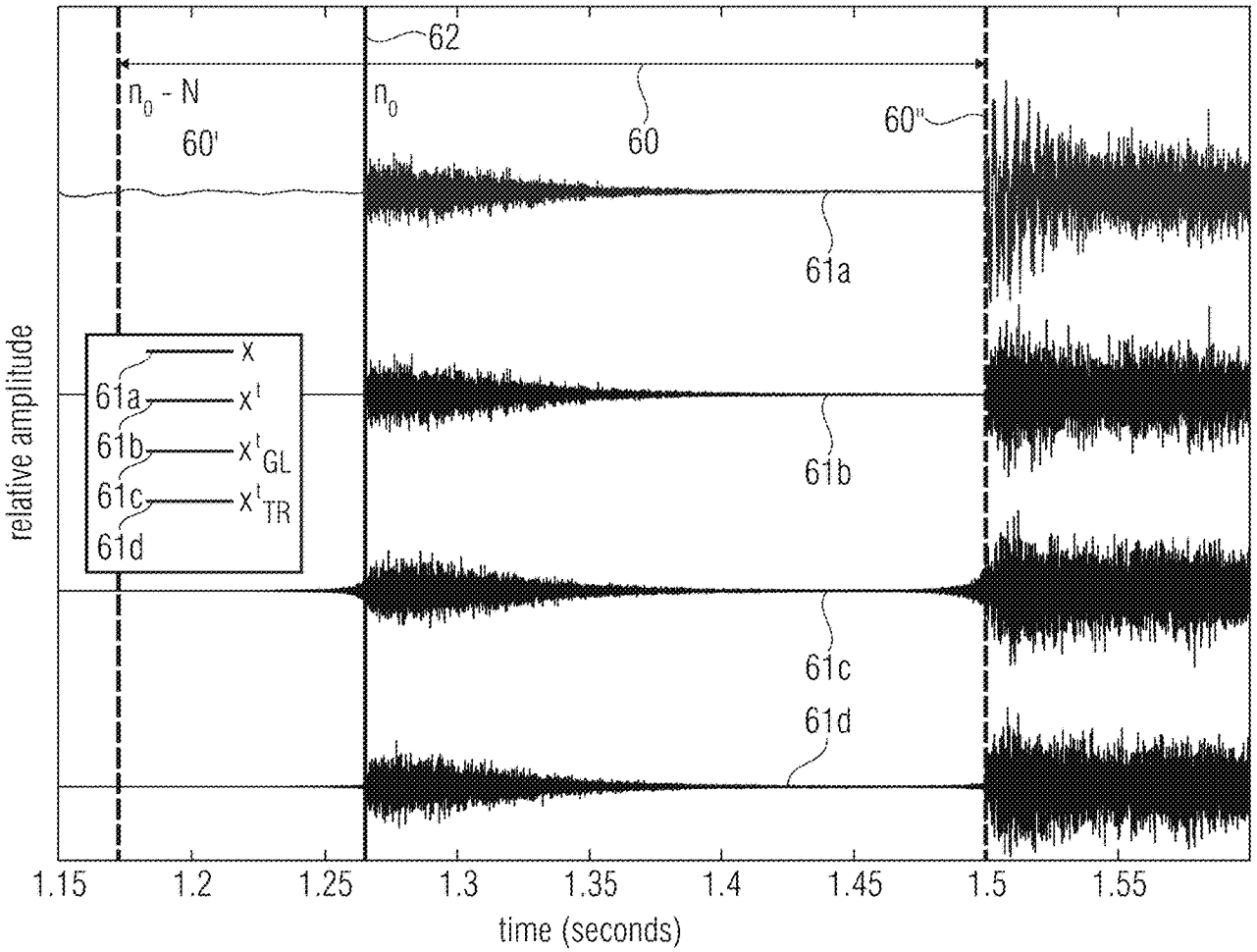
FIG. 8 shows a schematic time-domain diagram illustrating one segment of an audio signal.

FIG. 8 shows a schematic time-domain diagram illustrating one segment or frame of an audio signal or test-item. FIG. 8 shows the mixture signal 61*a*, the target hi-hat signal 61*b*, the reconstruction using LSEE-MSTFTM 61*c* compared to the transient restoration 61*d*, both obtained after 200 iterations applied per onset excerpt 60, which is, for example, the section between the dashed lines 60' and 60". The mixture signal 61*a* clearly exhibits the influence of the kick drum and snare drum to the target hi-hat signal 61*b*.

Figure 9A:
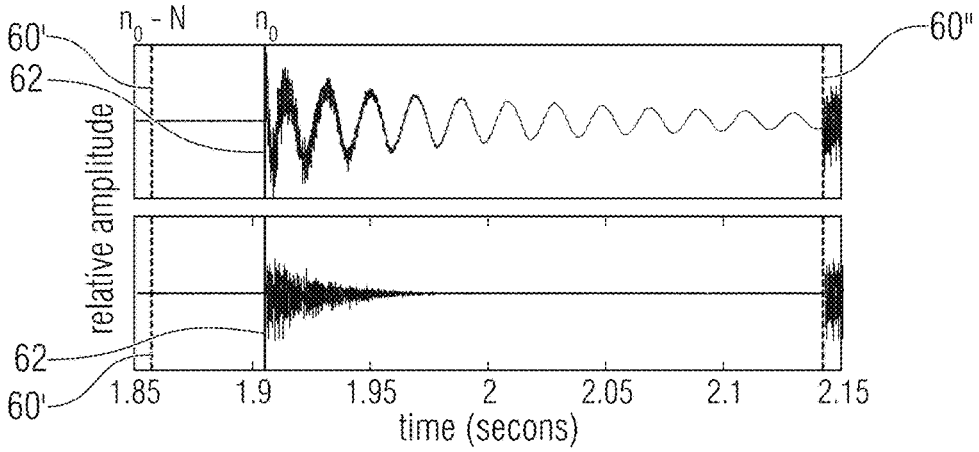
FIG. 9*a-c* illustrate schematic diagrams of different hi-hat component signals separated from an example drum loop.
Figure 9B:
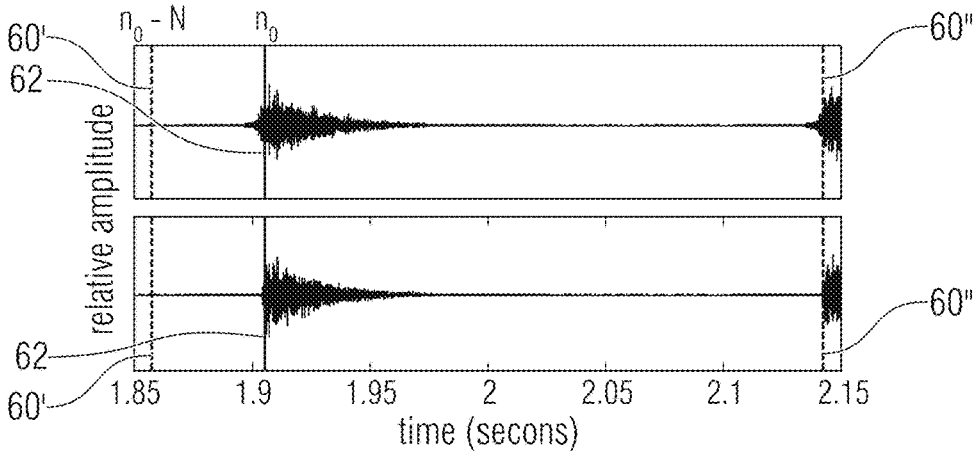
Figure 9C:
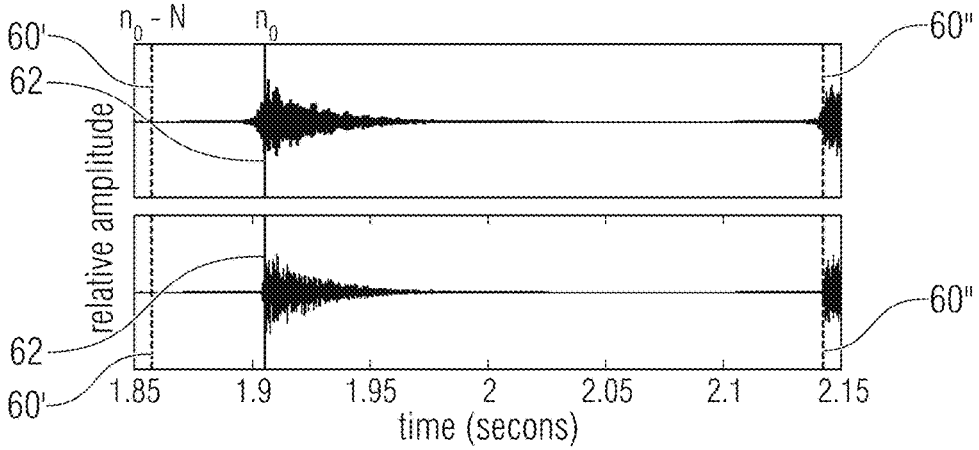

FIG. 9*a-c* illustrate schematic diagrams of different hi-hat component signals of an example drum loop. The transient position $n_0$ 62 is indicated by a solid line, wherein the excerpt boundaries 60' and 60" are indicated by dashed lines. FIG. 9*a* shows a mixture signal on top vs. an oracle hi-hat signal at the bottom. FIG. 9*b* shows a hi-hat signal obtained from initialization with the oracle magnitude and zero phase period. The reconstruction after L equals 200 iterations of GL is shown at the top of FIG. 9*b* vs. TR at the bottom of FIG. 9*b*. FIG. 9*c* shows a hi-hat signal obtained from initialization with NMFD-based magnitude in zero phase NMFD-based processing will be described with respect to (the specification of) FIGS. 12-14. Reconstruction after L equals 200 iterations of GL is presented at the top of FIG. 9*c* and TR at the bottom of FIG. 9*c*. Since the decomposition works very well for the example drum loop, there is almost no noticeable visual difference between FIG. 9*b* and FIG. 9*c*.

FIG. 10 shows a schematic illustration of the signal. FIG. 10*a* indicates the mixture signal x 64*a* as the sum of c=3 component signals $x_c$, each containing sequences of synthetic drum sound samples, for example from a Roland TR808 drum machine. $x_1$ 64*a*'" indicates a kick drum, $x_2$ 64*a*" indicates a snare drum, and $x_3$ 64*a*' indicates a hi-hat. FIG. 10*b* shows a time-frequency representation of the mixture's magnitude spectrogram V and c=3 component magnitude spectrograms $V_c$. For better visibility, the frequency axis is resampled to the logarithmic spacing and the magnitudes have been logarithmically compressed. Furthermore, the time-frequency representations of the signals 64*a* are indicated with the reference sign 64*b*. Moreover, in FIG. 9, the adjusted excerpt boundaries are visualized by the dashed lines and the virtually shifted $n_0$ by the solid line. Since the drum loops are realistic rhythms, the excerpts exhibit varying degree of superposition with the remaining drum instruments played simultaneously. In FIG. 9*a*, the mixture (top) exhibits pronounced influence of the kick drum compared to the isolated hi-hat signal (bottom). For comparison, the two top plots in FIG. 10*a* show a zoomed in version of the mixture x and the hi-hat component $x_3$ of the used example signal. In the bottom plot, one can see the kick drum $x_1$ in isolation. It is sampled from e.g. a Roland TR 808 drum computer and resembles a decaying sinusoid.

In the following, evaluation figures will be shown for different test scenarios, where two test cases for initializing the MSTFT are used. Case 1 uses the initial phase estimate $(\varphi_c)^{(0)}:=\varphi_{Mix}$ and the fixed magnitude estimate $\mathcal{A}_c:=\mathcal{A}_c^{Oracle}$. According to the transient notation, case 1 uses the initial phase estimate of $(\varphi)^{(0)}:=\varphi_{Mix}$, and the fixed magnitude estimate $\mathcal{A}^t:=\mathcal{A}_{Orig}^t$. In other words, the phase information of the separated signal or partial signal is taken from the phase of the mixture audio signal, instead of, for example, a phase of the separated signal or the partial signal. Moreover, case 2 uses the initial phase estimate $(\varphi_c)^{(0)}:=0$ and the fixed magnitude estimate $\mathcal{A}_c:=\mathcal{A}_c^{Oracle}$. According to the transient notation, case 2 is as the initial phase estimate $(\varphi)^{(0)}:=0$ and the fixed magnitude estimate $\mathcal{A}^t:=\mathcal{A}_{Orig}^t$. Herein, the initial phase estimate is initialized using the (arbitrary) value 0, even though an effect shown in FIG. 6*b* may be obtained. Furthermore, both test cases use amplitude values of the separated or partial signal of the audio signal. Again, it may be seen that the notation is mutually applicable.

$G((\chi_c)^{(l)}):=STFT(iSTFT((\chi_c)^{(l)}))$ is introduced to denote successive application of the iSTFT and STFT (core to the LSEE-MSTFTM algorithm) on $(\chi_c)^{(l)}$. Following [10], at each iteration l the normalized consistency measure (NCM) is computed as $$C((\mathcal{X}_c)^{(l)}, \mathcal{X}_c^{Oracle}) := 10\log_{10}\frac{\|G((\mathcal{X}_c)^{(l)}) - \mathcal{X}_c^{Oracle}\|^2}{\|\mathcal{X}_c^{Oracle}\|^2}, \tag{6}$$

for both test cases. As a more dedicated measure for the transient restoration, the pre-echo energy is computed as $$E((x_c)^{(l)}) := \sum_{n=n_0-N}^{n_0} |(x_c)^{(l)}(n)|^2, \tag{7}$$

from the section between the excerpt start and the transient location in the intermediate, time-domain component signal reconstructions $(x_c)^{(l)}:=iSTFT((\chi_c)^{(l)})$ for both test cases.

Figure 11A:
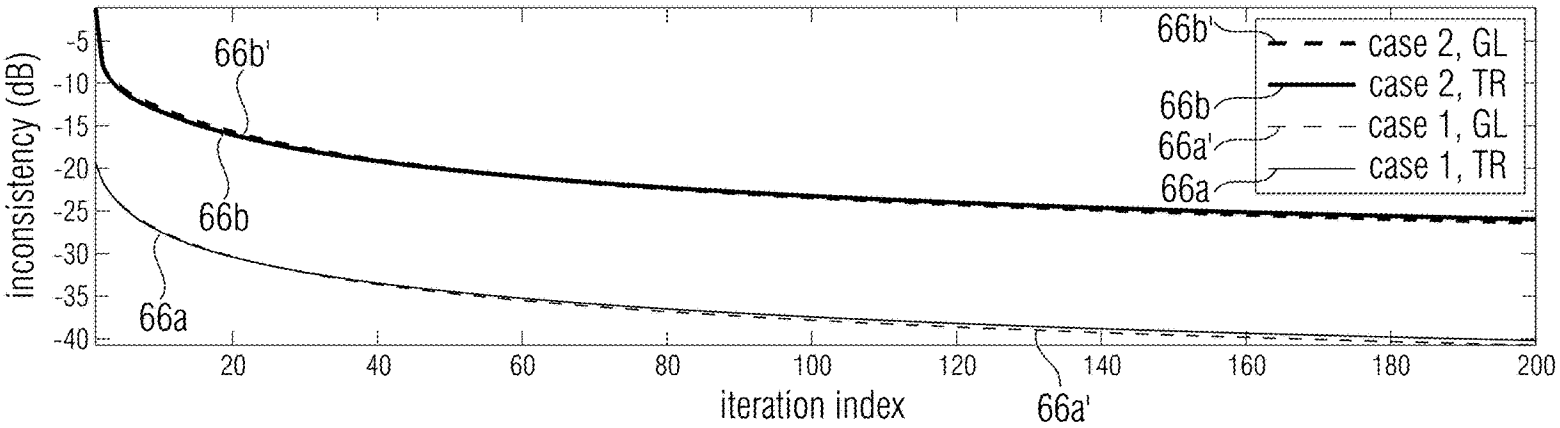
FIG. 11*a* shows an evolution of the normalized inconsistency measure vs. the number of iterations.
Figure 11B:
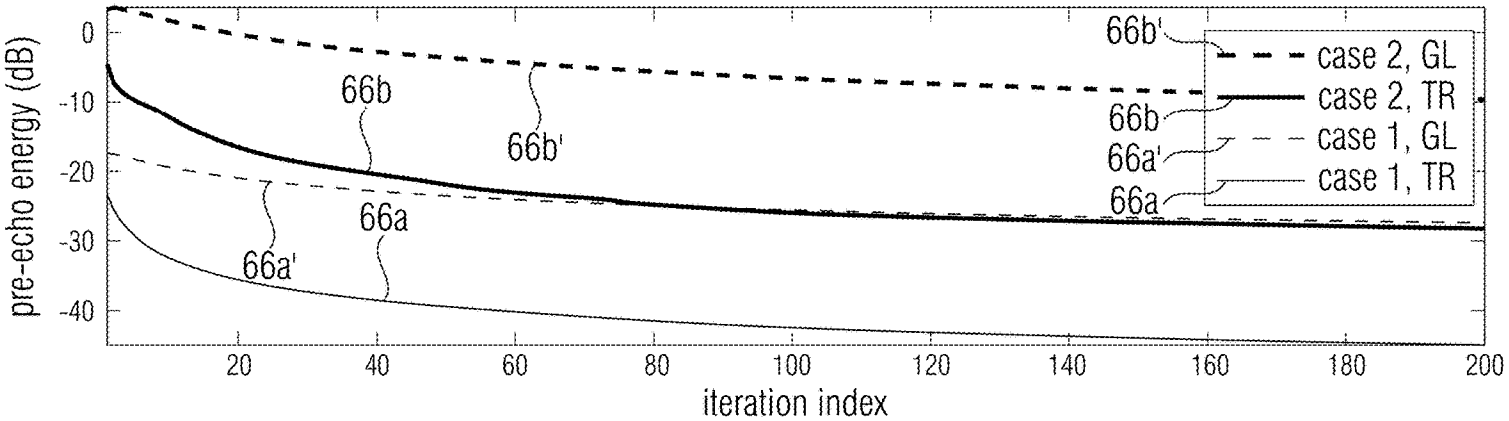
FIG. 11*b* shows the evolution of the pre-echo energy vs. the number of iterations.

FIG. 11*a* shows an evolution of the normalized consistency measure vs. the number of iterations. FIG. 11*b* shows the evolution of the pre-echo energy vs. the number of iterations. The curves show the average overall test excerpts. Moreover, results derived from using the GL algorithm are indicated by dashed lines, wherein results derived from the TR algorithm are indicated using solid lines. Moreover, the initialization of case 1 is indicated with reference number 66*a*, 66*a*', wherein curves derived using the initialization of case 2 are indicated with reference sign 66*b*, 66*b*'. The curves of FIG. 11 are derived by computing the STFT of each mixture excerpt via (1) with h=1024 and n=4096 and denote them as $\chi_{Mix}$. As a reference target, the same excerpt is taken, and the same zero padding is applied, at this time from the single track of each individual drum instrument, denoting the resulting STFT as $\chi_{Orig}^t$. The corresponding component signal is $\chi_c^{Oracle}$. L=200 iterations of both LSEE-MSTFTM (GL) and the proposed method or apparatus (TR) is used.

The evolution of both quality measures from (11) and (12) with respect to l is shown in FIG. 11. Diagram (a) indicates that, on average, the proposed method (TR) performs equally well as LSEE-MSTFTM (GL) in terms of inconsistency reduction. In both test cases, the same relative behavior of the measures for TR (solid line) and GL (dashed line) can be observed. As expected, the curves 66*a*, 66*a*' (case 1) start at much lower initial inconsistency than the curves 66*b*, 66*b*' (case 2), which is clearly due to the initialization with the mixture phase $\varphi_{Mix}$. Diagram 11*b* shows the benefit of TR for pre-echo reduction. In both test cases, the TR measures 66*a* 66*b* (solid lines) exhibit around 20 dB lower pre-echo energy compared to the GL measures (dashed line). Again, the more consistent initial $(\chi^t)^{(0)}$ of case 1 66*a*, 66*a*' may exhibit a considerable head start in terms of pre-echo reduction compared to case 2 66*b*, 66*b*'. Surprisingly, the proposed TR processing applied to case 2 slightly outperforms GL applied to case 1 in terms of pre-echo reduction for L>100. From these results, it may be inferred that it is sufficient to apply only a few iterations (e.g., L<20) of the proposed method in scenarios where a reasonable initial phase and magnitude estimate is available. However, there may be applied more iterations (e.g., L<200) in case a good magnitude estimate in conjunction with a weak phase estimate and vice versa is available. In FIG. 8, different versions of a segment from one test-item of test case 2 are shown. The TR reconstruction 61*d* clearly exhibits reduced pre-echos in comparison to the reconstruction with LSEE-MSTFTM 61*c*. The reference hi-hat signal 61*b* and the mixture signal 61*a* are shown for above.

However, the following figures are derived using a different hop size and a different window length as described below.

For each mixture excerpt, the STFT is computed via (1) with H=512 and N=2048 and denoted as $\chi_{Mix}$. Since all test items have 44:1 kHz sampling rate, the frequency resolution is approx. 21.5 Hz and the temporal resolution is approx. 11.6 ms. A symmetric Hann window of size N is used for w. As a reference target, the same excerpt boundaries are taken, the same zero-padding is applied, but this time from the single track of each individual drum instrument, the resulting STFT is denoted as $\chi_c^{Oracle}$. Subsequently, two different cases for the initialization of $(\chi_c)^{(0)}$ are defined as detailed above. Using these settings, the inconsistency of the resulting $(\chi_c)^{(0)}$ is expected to be lower in case 1 compared to case 2. Knowing that there exists a consistent $\chi_c^{Oracle}$, L=200 iterations of both LSEE-MSTFTM (GL) and the proposed method or apparatus (TR) are went through.

Figure 12A:
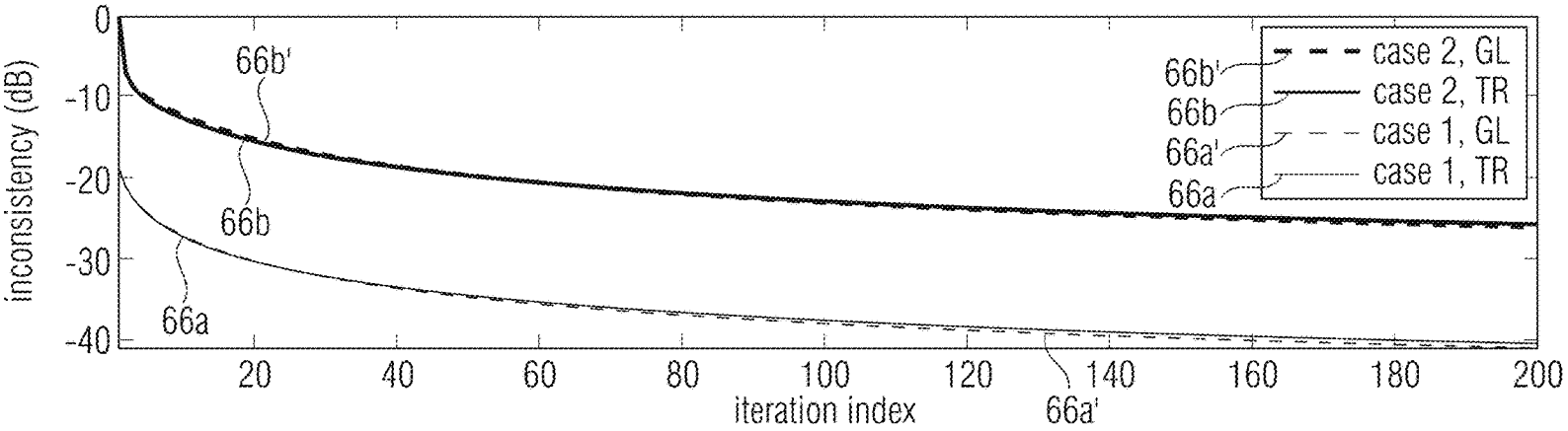
FIG. 12*a* shows a schematic diagram of an evolution of the normalized inconsistency measure vs. the number of iterations.
Figure 12B:
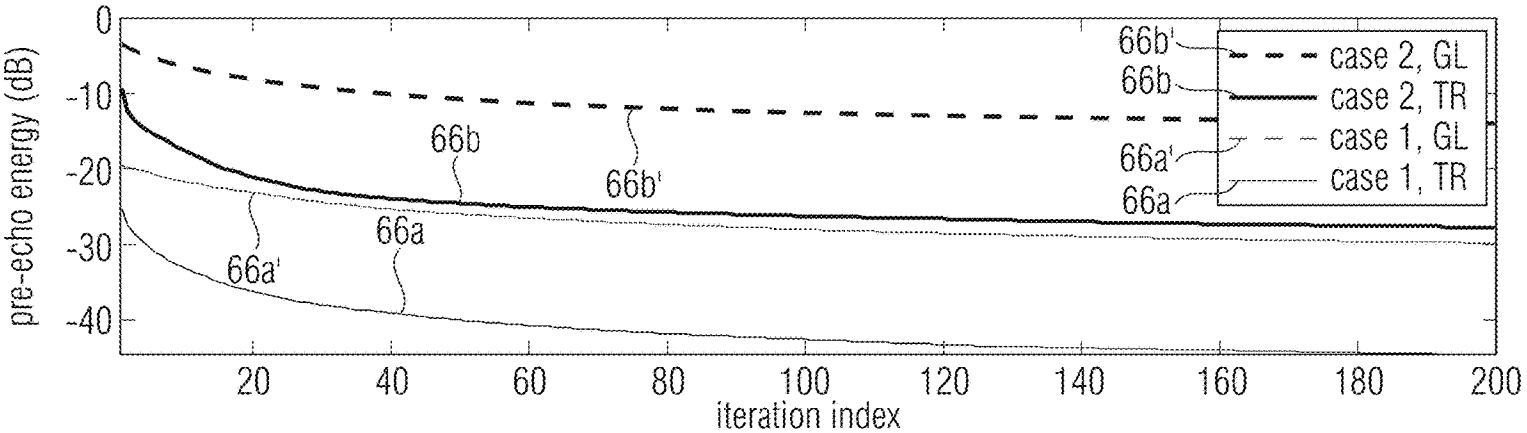
FIG. 12*b* shows the evolution of the pre-echo energy vs. the number of iterations.

FIG. 12*a* shows a schematic diagram of an evolution of the normalized consistency measure vs. the number of iterations. FIG. 12*b* shows the evolution of the pre-echo energy vs. the number of iterations. The curves show the average of all test excerpts. In other words, FIG. 12 shows the evolution of both quality measures from (6) and (7) with respect to l. FIG. 12*a* indicates that, on average, the proposed method (TR) performs equally well as LSEE-MSTFTM (GL) in terms of inconsistency reduction. In both test cases, the curves for TR (solid line) and GL (dashed line) are almost indistinguishable, which indicates that the new approach, meaning the method or apparatus, shows similar convergence properties as the original method. As expected, the curves 66*a*, 66*a*' (Case 1) start at much lower initial inconsistency than the curves 66*b*, 66*b*' (Case 2), which is clearly due to the initialization with the mixture phase $\varphi_{Mix}$. FIG. 12*b* shows the benefit of TR for pre-echo reduction. In both test cases, the pre-echo energy for TR (solid lines) is around 15 dB lower and shows a steeper decrease during the first few iterations compared to GL (dashed line). Again, the more consistent initial $(\chi_c)^{(0)}$ of Case 1 66*a*, 66*a*' exhibit a considerable head start in terms of pre-echo reduction compared to Case 2 66*b*, 66*b*'. From these results, it is inferred that it is sufficient to apply only a few iterations (e.g., L<20) of the proposed method in scenarios where a reasonable initial phase and magnitude estimate is available. However, applying more iterations (e.g., L<200) may be advantageous in case a good magnitude estimate in conjunction with a weak phase estimate and vice versa is present.

The following will describe embodiments of how to apply the proposed transient restoration method or apparatus in a score-informed audio decomposition scenario. An objective is the extraction of isolated drum sounds from polyphonic drum recordings with enhanced transient preservation. In contrast to the idealized laboratory conditions used before, the magnitude spectrograms of the component signals from the mixture is estimated. To this end, an NMFD (Non-Negative Matrix Factor Deconvolution) [3, 4] may be employed as decomposition technique. Embodiments describe a strategy to enforce score-informed constraints on NMFD. Finally, the experiments are repeated under these more realistic conditions and observations are discussed.

Following, the NMFD method employed for decomposing the TF-representation of x is briefly described. As already indicated, a wide variety of alternative separation approaches exists. Previous works [3, 4] successfully applied NMFD, a convolutive version of NMF, for drum sound separation. Intuitively speaking, the underlying, convolutive or convolution model assumes that all audio events in one of the component signals can be explained by a prototype event that acts as an impulse response to some onset-related activation (e.g., striking a particular drum). In FIG. 10*b* one can see this kind of behavior in the hi-hat component V3. There, all instances of the 8 onset events look more or less like copies of each other that could be explained by inserting a prototype event at each onset position.

Figure 13:
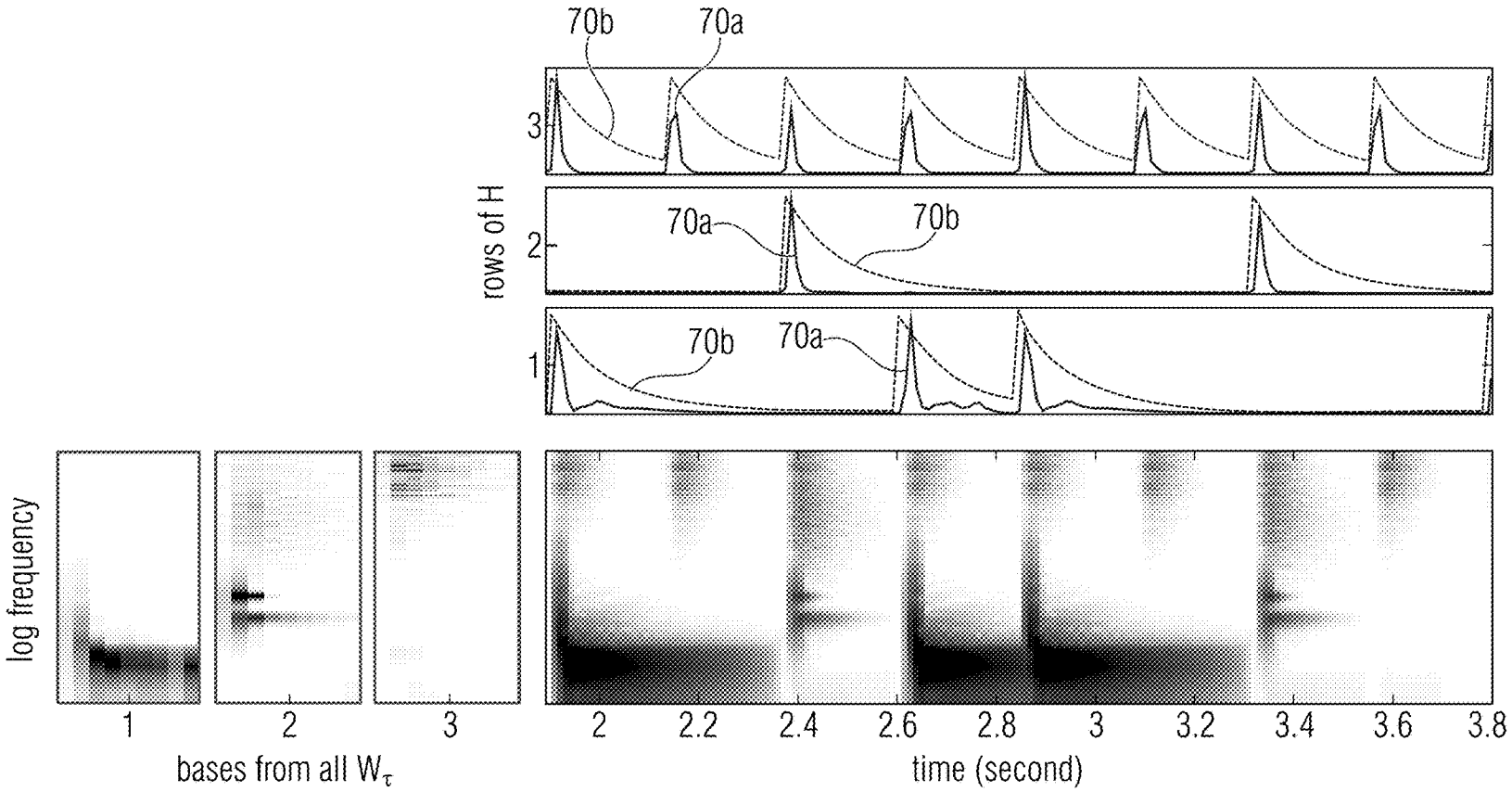
FIG. 13 shows a schematic diagram of a typical NMF decomposition result, illustrating the extracted templates (three leftmost plots) indeed resemble prototype versions of the onset events in V (lower right plot).

NMF can be used to compute a factorization $V \approx W \cdot H$, where the columns of $W \in \mathbb{R}_{\geq 0}^{K \times C}$ represent spectral basis functions (also called templates) and the rows of $H \in \mathbb{R}_{\geq 0}^{C \times M}$ contain time varying gains (also called activations). NMFD extends this model to the convolutive case by using two-dimensional templates so that each of the C spectral bases can be interpreted as a magnitude spectrogram snippet consisting of T<<M spectral frames. To this end, the convolutive spectrogram approximation $V \approx \nabla$ is modeled as $$\Lambda := \sum_{\tau=0}^{T-1} W_\tau \cdot \overset{\tau\rightarrow}{H}, \tag{8}$$

where $$\overset{\tau\rightarrow}{(\cdot)}$$

denotes a frame shift operator. As before, each column in $W_\tau \in \mathbb{R}_{\geq 0}^{K \times C}$ represents the spectral basis of a particular component, but this time T different versions of $W_\tau$ are available. By concatenating a specific column from all versions of $W_\tau$, it may be obtained a prototype magnitude spectrogram as shown in FIG. 13. NMFD typically starts with a suitable initialization of matrices $(W_\tau)^{(0)}$ and $(H)^{(0)}$. Subsequently, these matrices are iteratively updated to minimize a suitable distance measure between the convolutive approximation $\nabla$ and V.

FIG. 13 shows NMFD templates and activations computed for the example drum recording from FIG. 10. The magnitude spectrogram V is shown in the lower right plot. The three left on those plots are the spectral templates in $W_\tau$ that has been extracted via NMFD. Their corresponding activations 78 and the score-informed initialization 70*b* $(H)^{(0)}$ are shown in the three top plots.

Proper initialization of $(W_\tau)^{(0)}$ and $(H)^{(0)}$ is an effective means to constrain the degrees of freedom in the NMFD iterations and enforce convergence to a desired, musically meaningful solution. One possibility is to impose score-informed constraints derived from a time-aligned, symbolic transcription. To this end, the individual rows of $(H)^{(0)}$ are initialized as follows: Each frame corresponding to an onset of the respective drum instrument is initialized with an impulse of unit amplitude, all remaining frames with a small constant. Afterwards, a nonlinear exponential moving average filter is applied to model the typical short decay of a drum event. The outcome 70 of this initialization is shown as curve 70*b* in the top three plots of FIG. 13.

Best separation results may be obtained by score-informed initialization of both the templates and the activations. For separation of pitched instruments (e.g. piano), prototypical overtone series can be constructed in $(W_\tau)^{(0)}$. For drums, it is more difficult to model prototype spectral bases. Thus, it has been proposed to initialize the bases with averaged or factorized spectrograms of isolated drum sounds [21, 22, 4]. However, a simple alternative is used that first computes a conventional NMF whose activations H and templates W are initialized by the score-informed $(H)^{(0)}$ and setting $(W)^{(0)}:=1$.

With these settings, the resulting factorization templates are usually a pretty decent approximation of the average spectrum of each involved drum instrument. Simply replicating these spectra for all $\tau\in[0:T-1]$ serves as a good initialization for the template spectrograms. After some NMFD iterations, each template spectrogram typically corresponds to the prototype spectrogram of the corresponding drum instruments and each activation function corresponds to the deconvolved activation of all occurrences of that particular drum instrument throughout the recording. A typical decomposition result is shown in FIG. 13, where one can see that the extracted templates (three leftmost plots) do resemble prototype versions of the onset events in V (lower right plot). Furthermore, the location of the impulses in the extracted H 70*a* (three topmost plots) are very close to the maxima of the score-informed initialization.

In the following, it is described how to further process the NMFD results in order to extract the desired components. Let $H\in\mathbb{R}_{\geq 0}^{C\times\mathcal{M}}$ be the activation matrix learned by NMFD. Then, for each $c\in[0:C]$ the matrix $H_c\in\mathbb{R}_{\geq 0}^{C\times\mathcal{M}}$ is defined by setting all elements to zero except for the $c^{th}$ row that contains the desired activations previously found via NMFD. The $c^{th}$ component magnitude spectrogram is approximated by $$\Lambda_c := \sum_{\tau=0}^{T-1} W_\tau \cdot \overset{\tau\rightarrow}{H_c}.$$

Since the NMFD model yields only a low-rank approximation of V, spectral nuances may not be captured well. In order to remedy this problem, it is common practice to calculate soft masks that can be interpreted as a weighting matrix reflecting the contribution of $\Lambda_c$ to the mixture V. The mask corresponding to the desired component can be computed as $M_c:=\Lambda_c \oslash (\in+\Sigma_{c=1}^{C}\Lambda_c)$, where $\oslash$ denotes element-wise division and $\in$ is a small positive constant to avoid division by zero. The masking-based estimate of the component magnitude spectrogram is obtained as $V_c:=V\odot M_c$, with $\odot$ denoting element-wise multiplication. This procedure is also often referred to as Wiener filtering.

Following, the previous experiment of FIG. 12*a, b* are basically repeated. The same STFT parameters and excerpt boundaries are kept as used in the earlier examples. This time however, the component magnitude spectrograms are not derived from the oracle component signals, but extracted from the mixture using 30 NMFD iterations. Consequently, two new test cases are introduced. Test case 3 66*c*, 66*c*' uses the initial phase estimate $(\varphi_c)^{(0)}:=\varphi^{Mix}$ and the fixed magnitude estimate $\mathcal{A}_c:=V_c^T$, wherein test case 4 66*d* uses the initial phase estimate $(\varphi_c)^{(0)}:=0$ and the fixed magnitude estimate $\mathcal{A}_c:=V_c^T$.

Figure 14A:
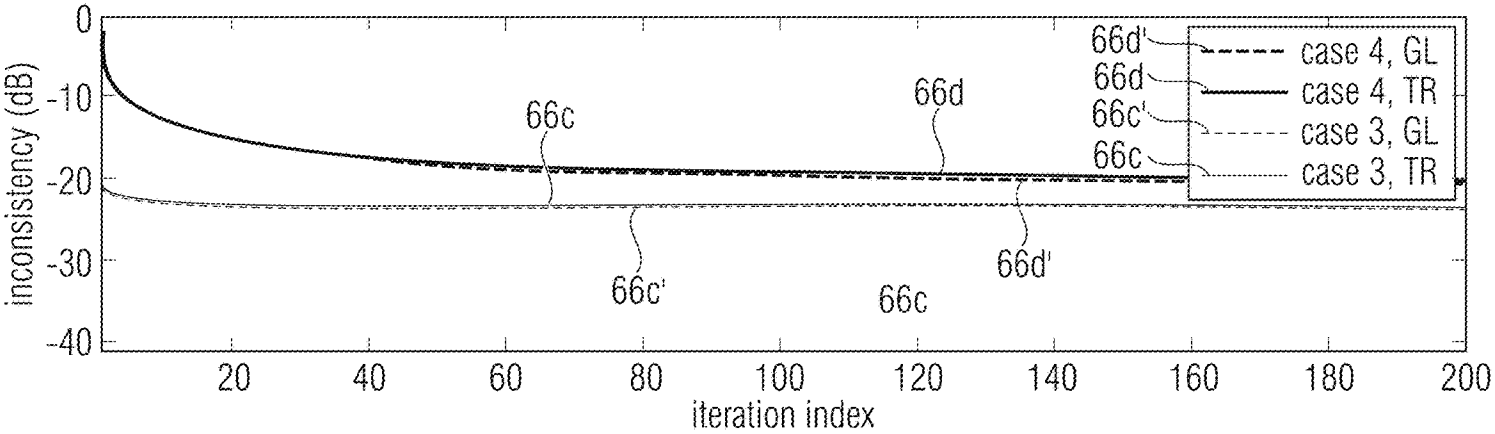
FIG. 14*a* shows a schematic diagram of an evolution of the normalized consistency measure vs. the number of iterations.
Figure 14B:
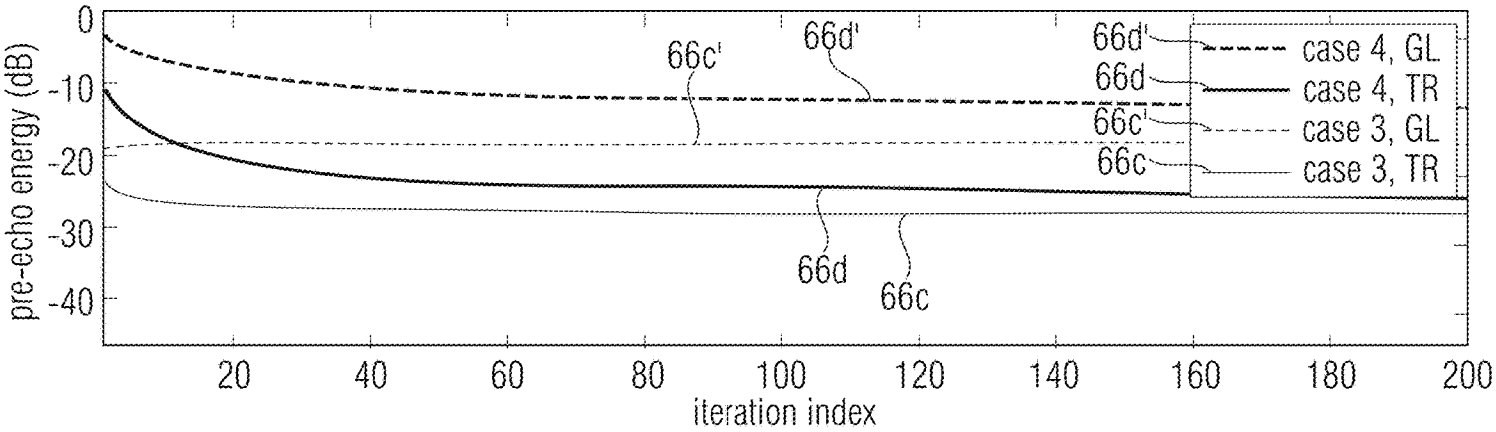
FIG. 14*b* shows a schematic diagram of an evolution of the pre-echo energy vs. the number of iterations.

FIG. 14*a* shows an evolution of the normalized consistency measure vs. the number of iterations. FIG. 14*b* shows an evolution of the pre-echo energy vs. the number of iterations. The curves show the average overall test excerpts, the axis limits are the same as in FIG. 12. Moreover, in FIG. 14*a*, the inconsistency reduction obtained using TR reconstruction 66*c*, 66*d* (solid lines) is indistinguishable from the GL method 66*c*', 66*d*' (dashed lines). The improvements are less significant compared to the numbers that can be obtained when using oracle magnitude estimates (compare FIG. 12*a*). On average, the reconstructions in Case 3 66*c*, 66*c*' (initialized with $\varphi^{Mix}$) seem to quickly get stuck in a local optimum. Presumably, this is due to imperfect NMFD decomposition of the onset related spectrogram frames, where all instruments exhibit a more or less flat magnitude distribution and thus show increased spectral overlap.

In FIG. 14*b*, pre-echo reduction with NMFD based magnitude estimates $\mathcal{A}_c:=V_c^T$ and zero phase (Case 4, plot 66*d*, 66*d*') works slightly worse than in Case 2 (compare FIG. 12*b*). This supports the earlier findings, that weak initial phase estimates benefit the most from applying many iterations of the proposed method. GL reconstruction using $\varphi^{Mix}$ (Case 3, plot 66*c*, 66*c*') slightly increases the pre-echo energy over the iterations. In contrast, applying the TR reconstruction yields a nice improvement.

In FIG. 9, different reconstructions of a selected hi-hat onset from the example drum loop is shown in detail. Regardless of the used magnitude estimate (oracle in FIG. 9*b* or NMFD-based in FIG. 9*c*), the proposed TR reconstruction (bottom) clearly exhibits reduced pre-echos in comparison to the conventional GL reconstruction (top). By informal listening tests (advantageously using headphones), one can clearly spot differences in the onset clarity that can be achieved with different combinations of MSTFT initializations and reconstruction methods. Even in cases, where imperfect magnitude decomposition leads to undesired cross-talk artifacts in the single component signals, the TR method according to embodiments better preserves transient characteristics than the conventional GL reconstruction. Furthermore, usage of the mixture phase for MSTFT initialization seems to be a good choice since one can often notice subtle differences in the reconstruction of the drum events' decay phase in comparison to the oracle signals. However, timbre differences caused by imperfect magnitude decomposition are much more pronounced.

Embodiments show an effective extension to Griffin and Lim's iterative LSEE-MSTFTM procedure for improved restoration of transient signal components in music source separation. The apparatus, encoder, decoder or the method uses additional side information about the location of the transients, which may be given in an informed source separation scenario.

According to further embodiments, an effective extension to Griffin and Lim's iterative LSEE-MSTFTM procedure for improved restoration of transient signal components in music source separation is shown. The method or apparatus uses additional side information about the location of the transients, which are assumed as given in an informed source separation scenario. Two experiments with the publicly available "IDMTSMT-Drums" data set showed that the method, encoder, or decoder according to embodiments is beneficial for reducing pre-echos both under laboratory conditions as well as for component signals obtained using a state-of-the-art source separation technique.

According to embodiments, the perceptual quality of transient signal components extracted in the context of music source separation is improved. Many state-of-the-art techniques are based on applying a suitable decomposition to the magnitude Short-Time Fourier Transform (STFT) of the mixture signal. The phase information used for the reconstruction of individual component signals is usually taken from the mixture, resulting in a complex-valued, modified STFT (MSTFT). There are different methods for reconstructing a time-domain signal whose STFT approximates the target MSTFT. Due to phase inconsistencies, these reconstructed signals are likely to contain artifacts such as pre-echos preceding transient components. Embodiments show an extension of the iterative signal reconstruction procedure by Griffin and Lim to remedy this issue. A carefully crafted experiment using a publicly available test-set shows that the method or apparatus considerably attenuates pre-echos while still showing similar convergence properties as the original approach.

In a further experiment, it is shown that the method or the apparatus considerably attenuates pre-echos while still showing similar convergence properties as the original approach by Griffin and Lim. A third experiment involving score-informed audio decomposition shows improvements as well.

The following figures will relate to further embodiments in connection with the apparatus 2.

Figure 15:
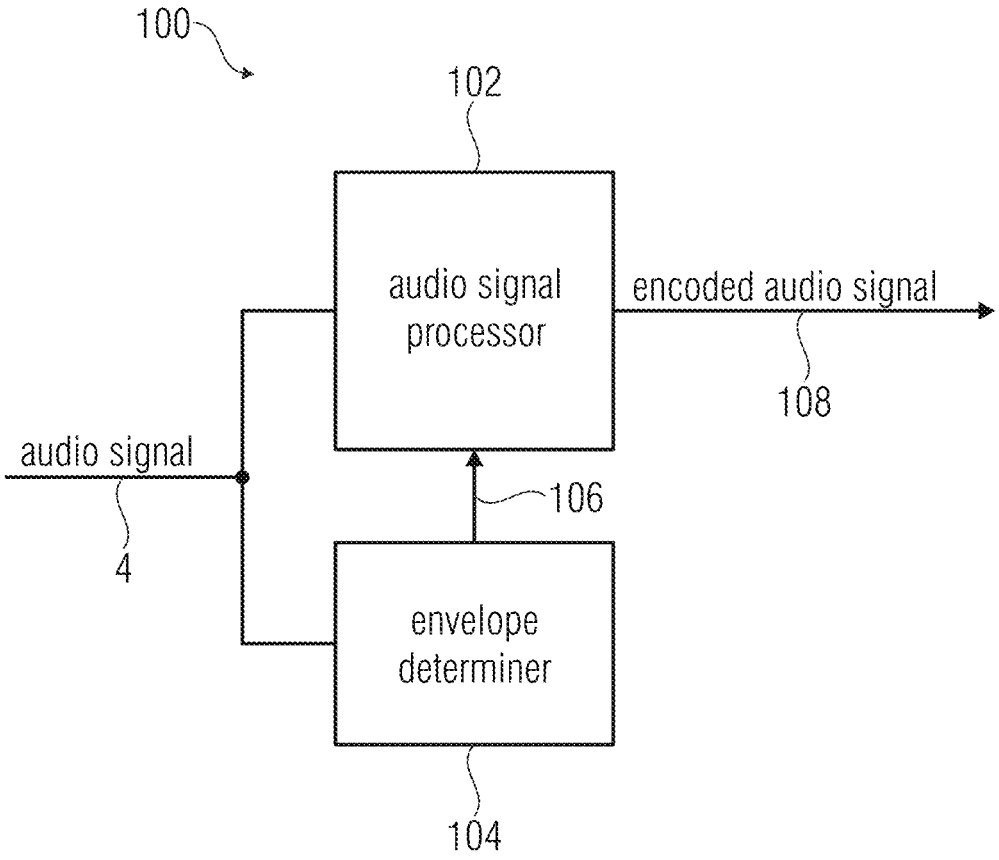
FIG. 15 shows an audio encoder for encoding an audio signal according to an embodiment.

FIG. 15 shows an audio encoder 100 for encoding an audio signal 4. The audio encoder comprises an audio signal processor and an envelope determiner. The audio signal processor 102 is configured for encoding a time-domain audio signal such that the encoded audio signal 108 comprises a representation of a sequence or frequency-domain frames of the time-domain audio signal and a representation of a target time-domain envelope 106. The envelope determiner is configured for determining an envelope from the time domain audio signal, wherein the envelope determiner is further configured to compare the envelope to a set of predetermined envelopes to determine a representation of the target time domain envelope based on the comparing. The envelope may be a time-domain envelope of a part of the audio signal, for example and envelope of a frame or a further portion of the audio signal. Moreover, the envelope may be provided to the audio signal processor which may be configured to include the envelope in the encoded audio signal.

In other words, a (standard) audio encoder may be extended to the audio encoder 100 by determining an envelope, for example a time-domain envelope of a portion, for example a frame of the audio signal. The derived envelope may be compared to a set or a number of predetermined time-domain envelopes in a codebook or a lookup table. The position of the best-fitting predetermined envelope may be encoded using, for example, a number of bits. Therefore, it may be used four bits to address e.g. 16 different predetermined time-domain envelopes, five bits to address e.g. 32 predetermined time-domain envelopes, or any further number of bits, depending on the number of different predetermined time-domain envelopes.

Figure 16:
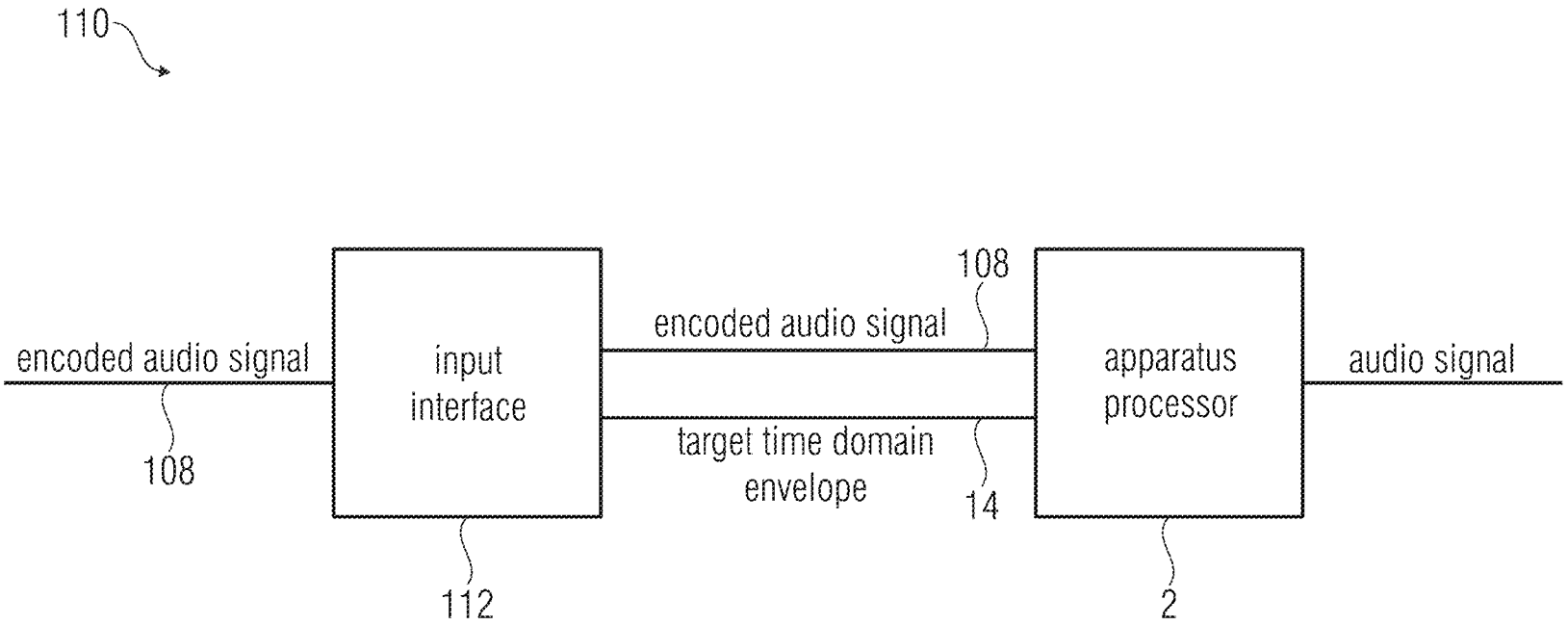
FIG. 16 shows an audio decoder comprising the apparatus and an input interface.

FIG. 16 shows an audio decoder 110 comprising the apparatus 2 and an input interface 112. The input interface 112 may receive an encoded audio signal. The encoded audio signal may comprise a representation of the sequence of frequency-domain frames and a representation of the target time-domain envelope.

In other words, the decoder 110 may receive the encoded audio signal for example from the encoder 100. The input interface 112 or the apparatus 2, or a further means may extract the target time-domain envelope 14 or a representation thereof, for example a sequence of bits indicating a position of the target time-domain envelope in a lookup table or a codebook. Furthermore, the apparatus 2 may decode the encoded audio signal 108 for example by adjusting corrupted phases of the encoded audio signal still having uncorrupted magnitude values, or the apparatus may correct phase values of a decoded audio signal, for example from a decoding unit which sufficiently or even perfectly decoded the encoded audio signal's spectral magnitude, and the apparatus further adjusts the phase of the decoded audio signal, which may be corrupted by the decoding unit.

Figure 17:
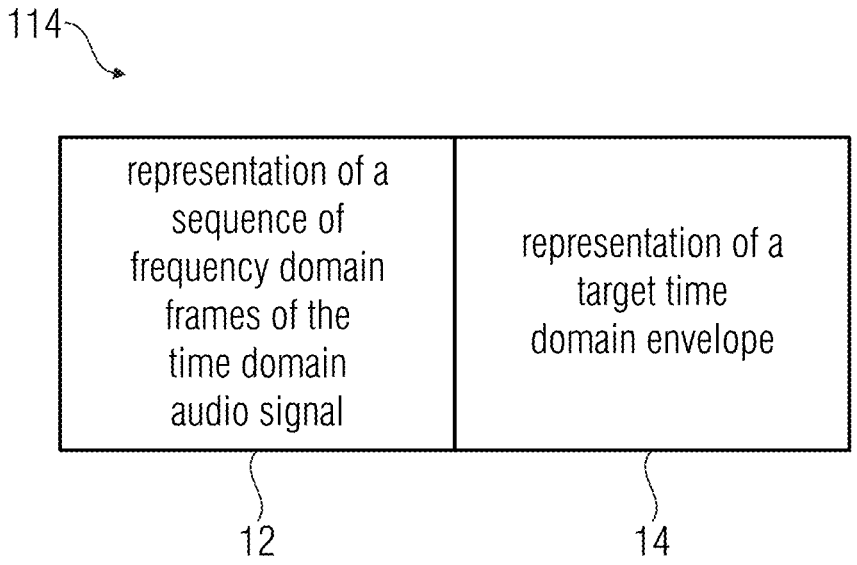
FIG. 17 shows an audio signal comprising a representation of a sequence of frequency-domain frames and a representation of a target time-domain envelope.

FIG. 17 shows an audio signal 114 comprising a representation of a sequence of frequency-domain frames 12 and a representation of a target time-domain envelope 14. The representation of a sequence of frequency-domain frames of the time-domain audio signal 12 may be an encoded audio signal according to a standard audio encoding scheme. Furthermore, the representation of a target time-domain envelope 14 may be a bit representation of the target time-domain envelope. The bit representation may be derived, for example, using sampling and quantization of the target time-domain envelope or by a further digitalization method. Moreover, the representation of the target time-domain envelope 14 may be an index of, for example, a codebook or a lookup table indicated or coded with a number of bits.

Figure 18:
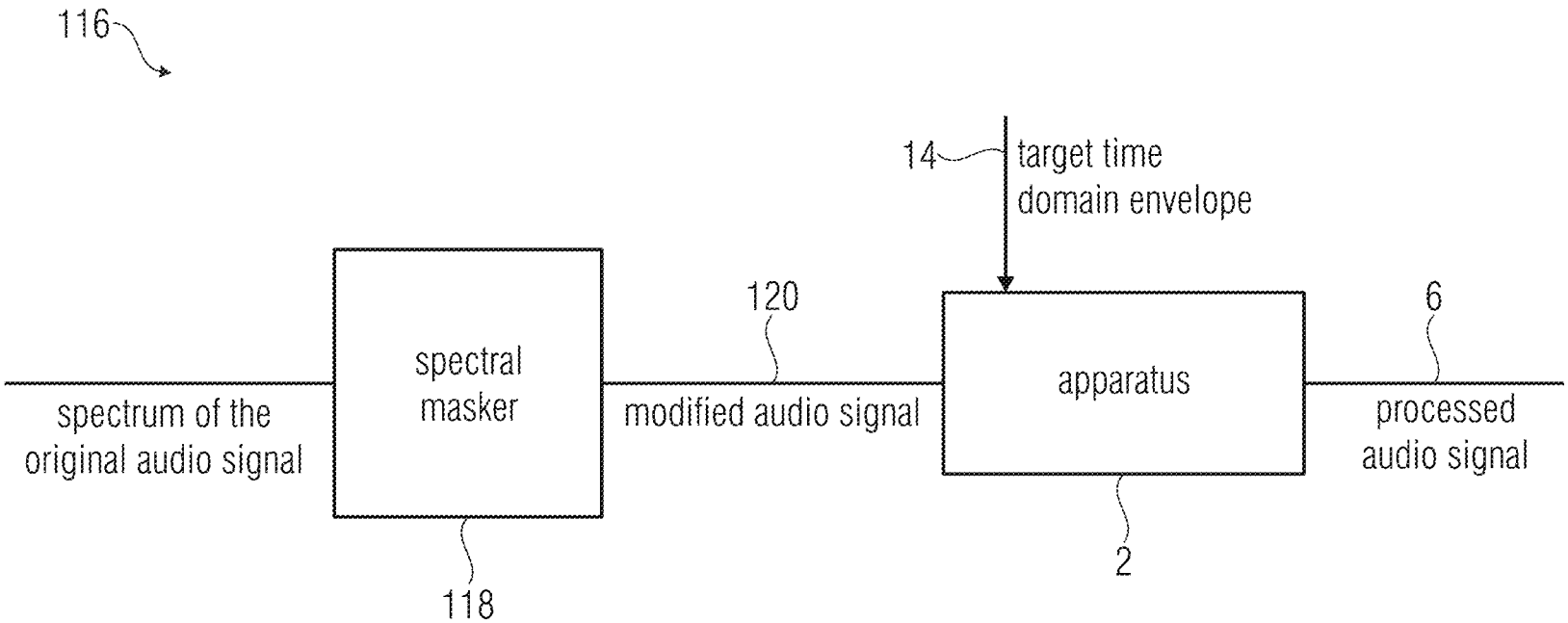
FIG. 18 shows a schematic block diagram of an audio source separation processor according to an embodiment.

FIG. 18 shows a schematic block diagram of an audio source separation processor 116 according to an embodiment. The audio source separation processor comprises the apparatus 2 and a spectral masker 118. The spectral masker may mask a spectrum of the original audio signal 4 to derive a modified audio signal 120. Compared to the original audio signal 4, the modified audio signal 120 may comprise a reduced number of frequency bands or time frequency bins. Furthermore, the modified audio signal may comprise only one source or one instrument or one (human) speaker of the audio signal 4, wherein frequency contributions of other sources, speakers, or instruments are hidden or masked out. However, since magnitude values of the modified audio signal 120 may match magnitude values of a (desired) processed audio signal 6, phase values of the modified audio signal may be corrupted. Therefore, the apparatus 2 may correct the phase values of the modified audio signal with respect to the target time-domain envelope 14.

Figure 19:
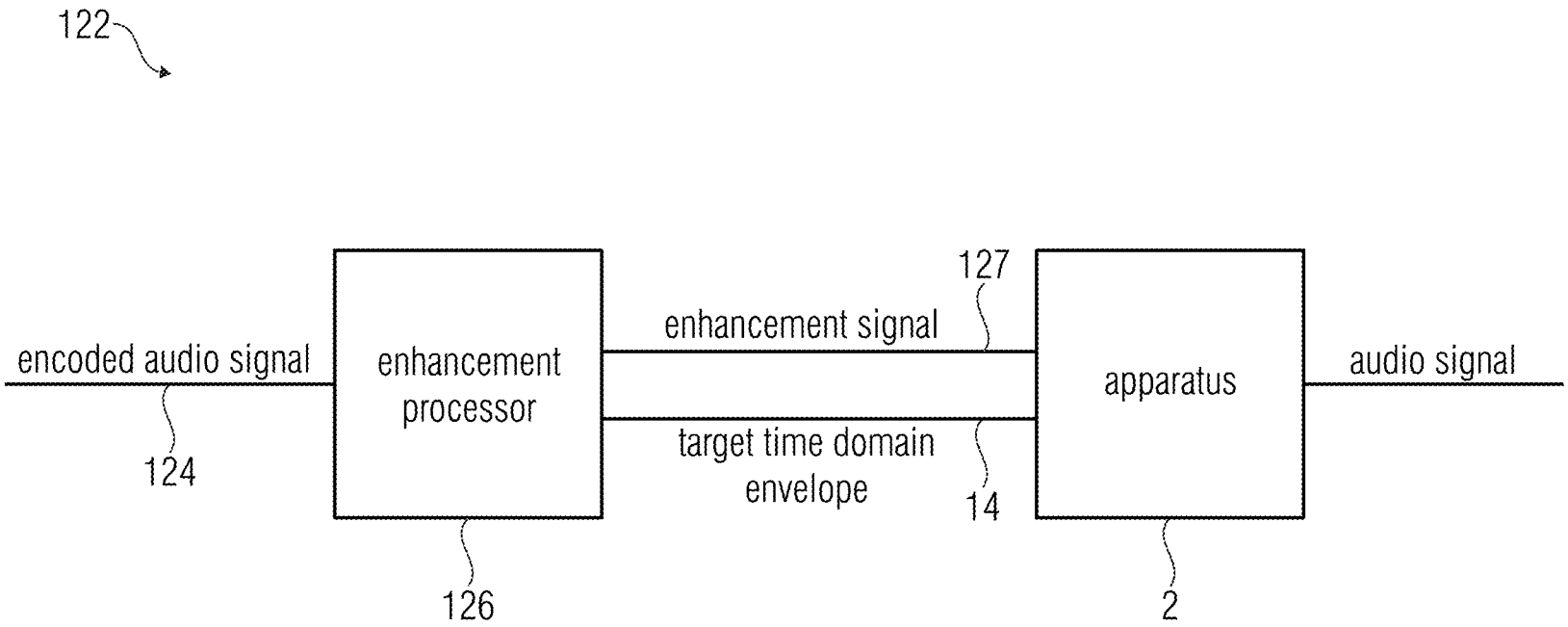
FIG. 19 shows a schematic block diagram of a bandwidth enhancement processor according to an embodiment.

FIG. 19 shows a schematic block diagram of a bandwidth enhancement processor 122 according to an embodiment. The bandwidth enhancement processor 122 is configured for processing an encoded audio signal 124. Moreover, the bandwidth enhancement processor 122 comprises an enhancement processor 126 and the apparatus 2. The enhancement processor 126 is configured to generate an enhancement signal 127 from an audio signal band included in the encoded signal and wherein the enhancement processor 126 is configured to extract the target time-domain envelope 14 from an encoded representation included in the encoded signal 122 or from the audio signal band included in the encoded signal. Furthermore, the apparatus 2 may process the enhancement signal 126 using the target time-domain envelope.

In other words, the enhancement processor 126 may core-encode the audio signal band or receive a core-encoded audio signal band of the encoded audios signal. Furthermore, the enhancement processor 126 may calculate further bands of the audio signal using, for example parameters of the encoded audio signal and the core-encoded baseband portion of the audio signal. Moreover, the target time domain envelope 14 may be present in the encoded audio signal 124, or the enhancement processor may be configured to calculate the target time-domain envelope from the baseband portion of the audio signal.

Figure 20:
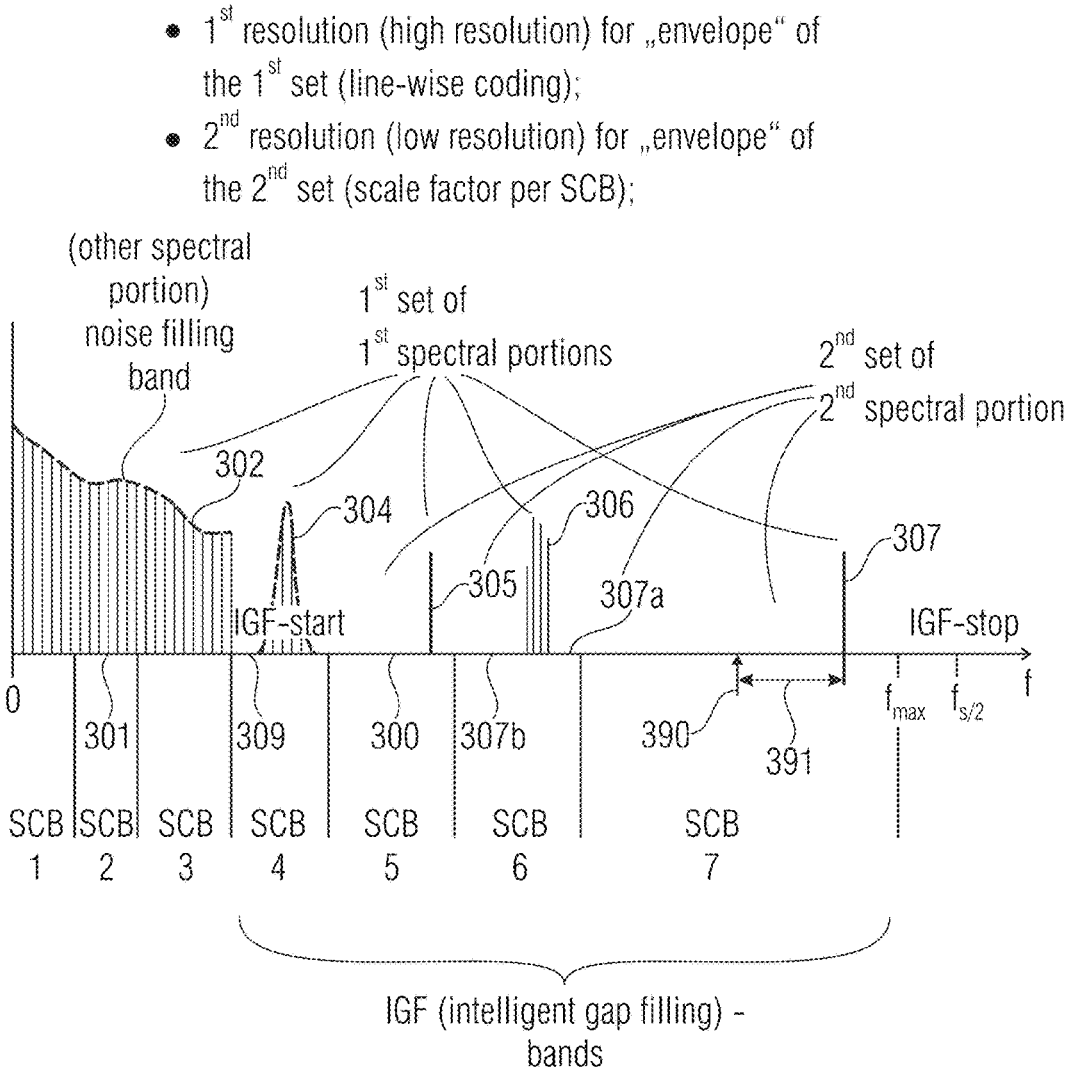
FIG. 20 shows a schematic frequency-domain diagram illustrating bandwidth enhancement.

FIG. 20 illustrates a schemaftic representation of the spectrum. The spectrum is subdivided in scale factor bands SCB where there are seven scale factor bands SCB1 to SCB7 in the illustrated example of FIG. 20. The scale factor bands can be AAC scale factor bands which are defined in the AAC standard and have an increasing bandwidth to upper frequencies as illustrated in FIG. 20 schematically. It is advantageous to perform intelligent gap filling not from the very beginning of the spectrum, i.e., at low frequencies, but to start the IGF operation at an IGF start frequency illustrated at 309. Therefore, the core frequency band extends from the lowest frequency to the IGF start frequency. Above the IGF start frequency, the spectrum analysis is applied to separate high resolution spectral components 304, 305, 306, 307 (the first set of first spectral portions) from low resolution components represented by the second set of second spectral portions. FIG. 20 illustrates a spectrum which is exemplarily input into the enhancement processor 126, i.e., the core encoder may operate in the full range, but encodes a significant amount of zero spectral values, i.e., these zero spectral values are quantized to zero or are set to zero before quantizing or subsequent to quantizing. Anyway, the core encoder operates in full range, i.e., as if the spectrum would be as illustrated, i.e., the core decoder does not necessarily have to be aware of any intelligent gap filling or encoding of a second set of second spectral portions with a lower spectral resolution.

Advantageously, the high resolution is defined by a line-wise coding of spectral lines such as MDCT lines, while the second resolution or low resolution is defined by, for example, calculating only a single spectral value per scale factor band, where a scale factor band covers several frequency lines. Thus, the second low resolution is, with respect to its spectral resolution, much lower than the first or high resolution defined by the line-wise coding typically applied by the core encoder such as an AAC or USAC core encoder.

Due to the fact that the encoder is a core encoder and due to the fact that there can, but does not necessarily have to be, components of the first set of spectral portions in each band, the core encoder calculates a scale factor for each band not only in the core range below the IGF start frequency 309, but also above the IGF start frequency until the maximum frequency $f_{1GFstop}$ which is smaller or equal to the half of the sampling frequency, i.e., $f_{s/2}$. Thus, the encoded tonal portions 302, 304, 305, 306, 307 of FIG. 20 and, in this embodiment together with the scale factors SCB1 to SCB7 correspond to the high resolution spectral data. The low resolution spectral data are calculated starting from the IGF start frequency and correspond to the energy information values $E_1$, $E_2$, $E_3$, $E_4$, which are transmitted together with the scale factors SF4 to SF7.

Particularly, when the core encoder is under a low bitrate condition, an additional noise-filling operation in the core band, i.e., lower in frequency than the IGF start frequency, i.e., in scale factor bands SCB1 to SCB3 can be applied in addition. In noise-filling, there exist several adjacent spectral lines which have been quantized to zero. On the decoder-side, these quantized to zero spectral values are re-synthesized and the re-synthesized spectral values are adjusted in their magnitude using a noise-filling energy. The noise-filling energy, which can be given in absolute terms or in relative terms particularly with respect to the scale factor as in USAC corresponds to the energy of the set of spectral values quantized to zero. These noise-filling spectral lines can also be considered to be a third set of third spectral portions which are regenerated by straightforward noise-filling synthesis without any IGF operation relying on frequency regeneration using frequency tiles from other frequencies for reconstructing frequency tiles using spectral values from a source range and the energy information $E_1$, $E_2$, $E_3$, $E_4$.

Advantageously, the bands, for which energy information is calculated coincide with the scale factor bands. In other embodiments, an energy information value grouping is applied so that, for example, for scale factor bands 4 and 5, only a single energy information value is transmitted, but even in this embodiment, the borders of the grouped reconstruction bands coincide with borders of the scale factor bands. If different band separations are applied, then certain re-calculations or synchronization calculations may be applied, and this can make sense depending on the certain implementation.

The core-encoded portion or core encoded frequency band of the encoded audio signal 124 may comprise a high resolution representation of the audio signal up to a cutoff frequency or the IGF start frequency 309. Above this IGF start frequency 309 the audio signal may comprise scale factor bands encoded with a low resolution, for example using parametric encoding. However, using the core-encoded baseband portion and e.g. the parameters, the encoded audio signal 124 can be decoded. This may be performed once or multiple times.

This may provide a good reconstruction of magnitude values even above the first cutoff frequency 130. However, at least around the cutoff frequencies between consecutive scale factor bands, an upmost or highest frequency of the core-encoded baseband portion 128 may be adjacent to a lowest frequency of the core-encoded baseband portion due to padding of the core-encoded baseband portion to higher frequencies above the IGF start frequency 309, phase values may be corrupted. Therefore, the baseband reconstructed audio signal may be input into the apparatus 2 to rebuild the phases of the bandwidth-extended signal.

Furthermore, the bandwidth enhancement works since the core-encoded baseband portion comprises much information regarding the original audio signal. This leads to the conclusion that an envelope of the core-encoded baseband portion is at least similar to an envelope of the original audio signal, even though the envelope of the original audio signal may be more accentuated due to further high-frequency components of the audio signal, which are not present or absent in the core-encoded baseband portion.

Figure 21:
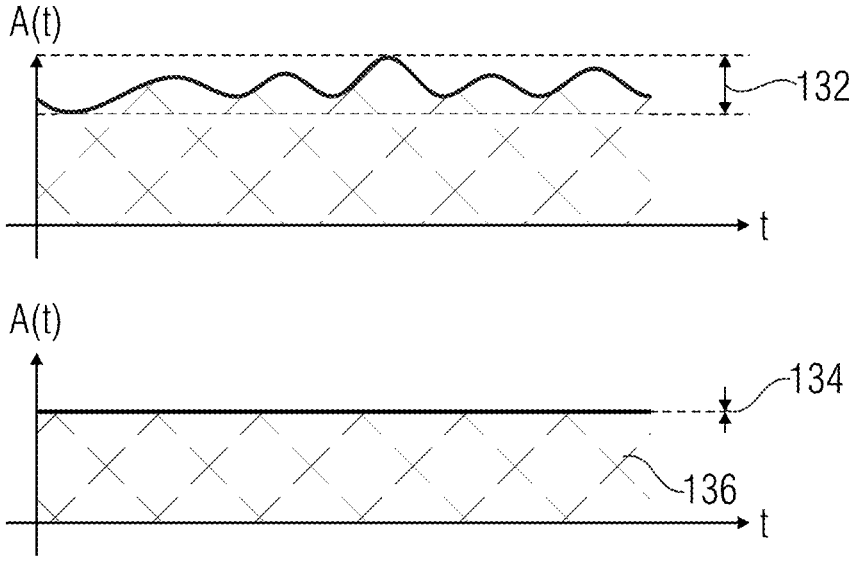
FIG. 21 shows a schematic representation of the (intermediate) time-domain reconstruction.

FIG. 21 shows a schematic representation of the (intermediate) time-domain reconstruction after a first number of iteration steps on top, and after a second number of iteration steps being greater than the first number of iteration steps at the bottom of FIG. 21. The comparably high ripples 132 result from an inconsistency of adjacent frames of the sequence of frequency-domain frames. Usually, starting from a time-domain signal, the inverse STFT of the STFT of the time-domain signal results again in the time-domain signal. Herein, adjacent frequency-domain frames are consistent after the STFT is applied, such that the overlap-and-add procedure of the inverse STFT operation sums up or reveals the original signal. However, starting from the frequency-domain with corrupted phase values, adjacent frequency-domain frames are not consistent (i.e., inconsistent), wherein the STFT of the ISTFT of the frequency-domain signal does not lead to a proper or consistent audio signal as indicated at the top of FIG. 21. However, it is mathematically proven that the algorithm, if iteratively applied to the original magnitude, reduces the ripples 132 in each iteration step leading to a (nearly perfect) reconstructed audio signal indicated at the bottom of FIG. 21. Herein, ripples 132 are reduced. In other words, the magnitude of the intermediate time-domain signal converts to the initial magnitude value of the sequence of frequency-domain frames after each iteration step. It has to be noted that the hop size of 0.5 between consecutive synthesis windows 136 is chosen for convenience and may be set to any appropriate value, such as e.g. 0.75.

Figure 22:
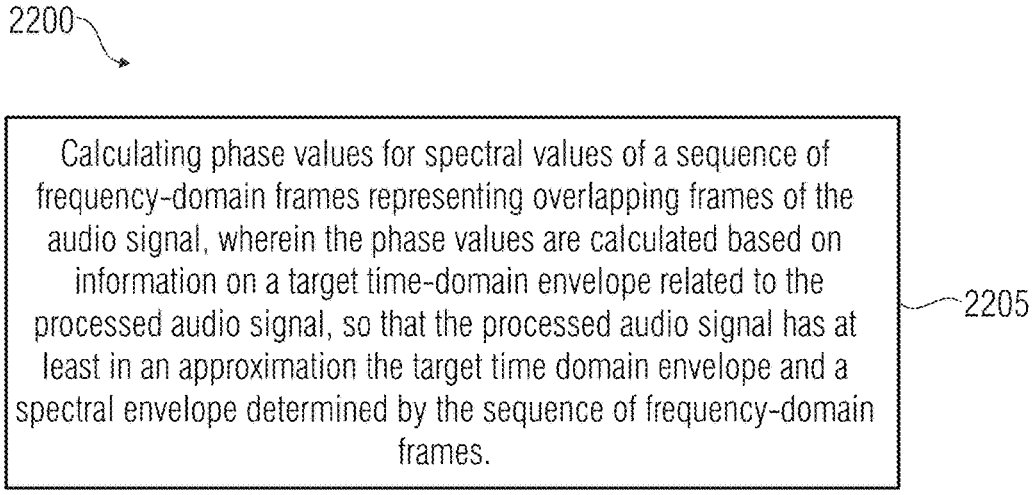
FIG. 22 shows a schematic block diagram of a method for processing an audio signal to obtain a processed audio signal.

FIG. 22 shows a schematic block diagram of a method 2200 for processing an audio signal to obtain a processed audio signal. The method 2200 comprises a step 2205 of calculating phase values for spectral values of a sequence of frequency-domain frames representing overlapping frames of the audio signal, wherein the phase values are calculated based on information on a target time-domain envelope related to the processed audio signal, so that the processed audio signal has at least in an approximation the target time-domain envelope and the spectral envelope determined by the sequence of frequency-domain frames.

Figure 23:
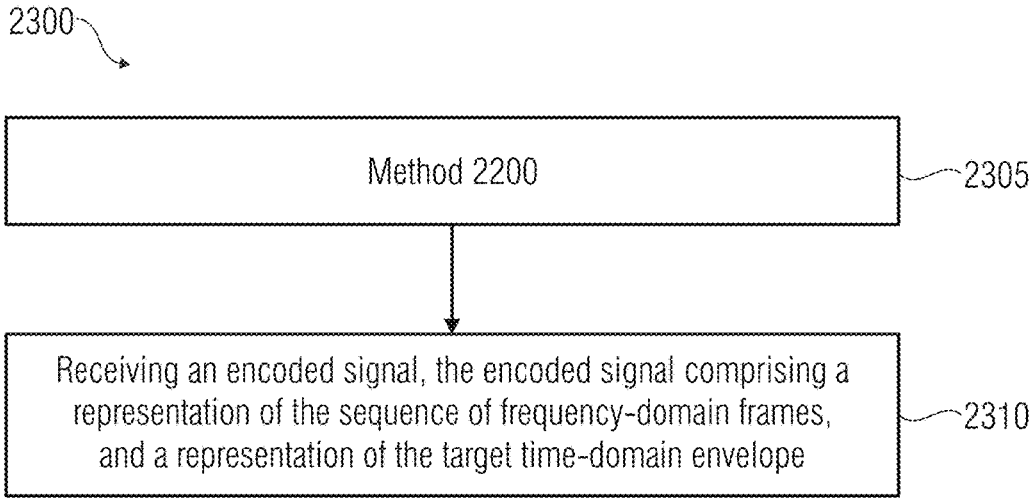
FIG. 23 shows a schematic block diagram of a method of audio decoding.

FIG. 23 shows a schematic block diagram of a method 2300 of audio decoding. The method 2300 comprises in a step 2305 the method 2200 and in a step 2310, receiving an encoded signal, the encoded signal comprising a representation of the sequence of frequency-domain frames, and a representation of the target time-domain envelope.

Figure 24:
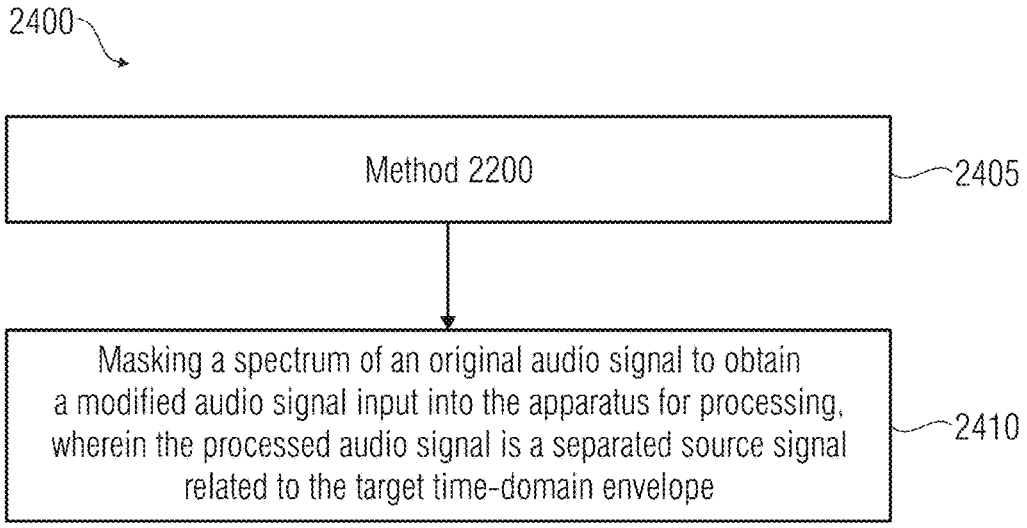
FIG. 24 shows a schematic block diagram of a method of audio source separation.

FIG. 24 shows a schematic block diagram of a method 2400 of audio source separation. The method 2400 comprises a step 2405 to perform the method 2200, and a step 2410 of masking a spectrum of an original audio signal to obtain a modified audio signal input into the apparatus for processing, wherein the processed audio signal is a separated source signal related to the target time-domain envelope.

Figure 25:
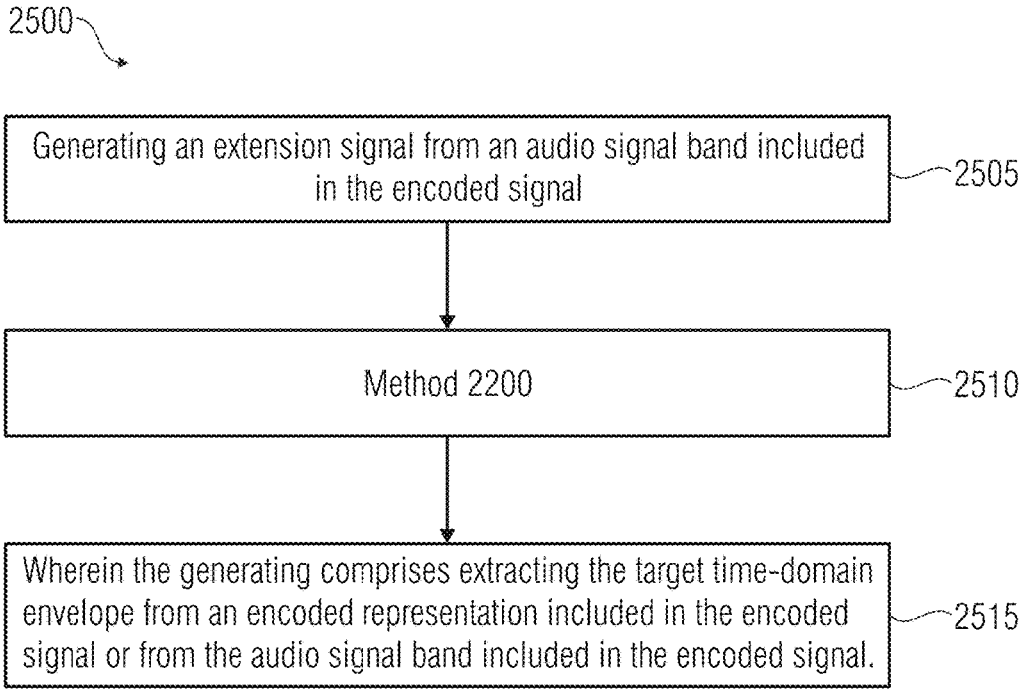
FIG. 25 shows a schematic block diagram of a method of bandwidth enhancement of an encoded audio signal.

FIG. 25 shows a schematic block diagram of a method of bandwidth enhancement of an encoded audio signal. The method 2500 comprises a step 2505 of generating an enhancement signal from an audio signal band included in the encoded signal, a step 2510 to perform the method 2200, and a step 2515, wherein the general operating comprises extracting the target time-domain envelope from an encoded representation included in the encoded signal or from the audio signal band included in the encoded signal.

Figure 26:
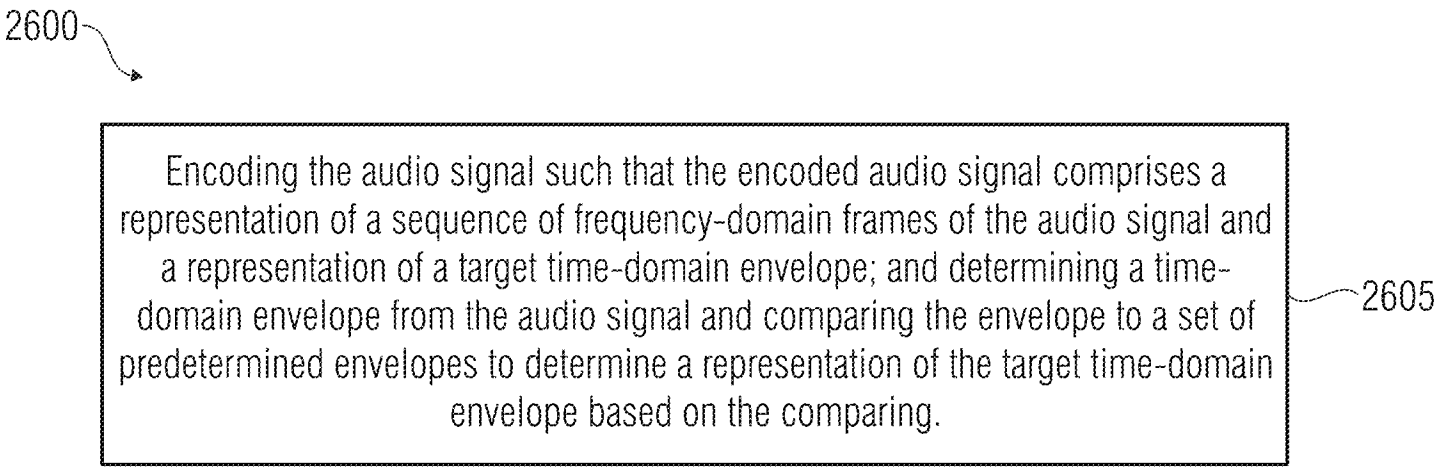
FIG. 26 shows a schematic block diagram of a method of audio encoding.

FIG. 26 shows a schematic block diagram of a method 2600 of audio encoding. The method 2600 comprises a step 2605 of encoding a time-domain audio signal such that the encoded audio signal comprises a representation of a sequence of frequency-domain frames of the time-domain audio signal and a representation of a target time-domain envelope, and a step 2610 of determining an envelope from the time-domain audio signal, wherein the envelope determiner is further configured to compare the envelope to a set of predetermined envelopes to determine a representation of the target time-domain envelope based on the comparing.

Further embodiments of the invention relate to the following examples. This may be a method, an apparatus, or a computer program to 1) iteratively reconstruct a time-domain signal from a time-frequency domain representation,
2) generate an initial estimate for the magnitude and the phase information and the time-frequency domain representation,
3) apply intermediate signal manipulations to certain signal properties during the iterations,
4) transform the time-frequency domain representation back to the time-domain,
5) modulate the intermediate time-domain signal with an arbitrary amplitude envelope,
6) transform the modulated time-domain signal back to the time-frequency domain,
7) use the resulting phase information to update the time-frequency domain representation,
8) emulate the sequence of inverse transform and forward transform by a time-frequency domain procedure that adds specifically convolved and shifted contributions from adjacent frames to a central frame,
9) approximate the above procedure by using truncated convolution kernels and exploiting symmetry properties,
10) emulate the time-domain modulation by convolution of the desired frames with the time-frequency representation of the target envelope,
11) apply the time-frequency domain manipulations in a time-frequency dependent manner, for example apply the operations only to select time-frequency bins, or
12) use the above-described procedures for perceptual audio coding, audio source separation, and/or bandwidth enhancement.

Multiple kinds of evaluations in an audio decomposition scenario are applied to the apparatus or the method according to embodiments, where an objective is to extract isolated drum sounds from polyphonic drum recordings. A publicly available test set may be used that is enriched with all side information, such as the true "oracle" component signals and their precise transient positions. In one experiment, under laboratory conditions, use of all side-information is made in order to focus on evaluating the benefit of the proposed method or apparatus for transient preservation in signal reconstruction. Under these idealized conditions, a proposed method may considerably attenuate pre-echos while still exhibiting similar convergence properties as the original method or apparatus. In a further experiment, a state-of-the-art decomposition technique [3, 4] is employed with score-informed constraints to estimate the component signal's STFTM from the mixture. Under these (more realistic) conditions, the proposed method still yields significant improvements.

It is to be understood that in this specification, the signals on lines are sometimes named by the reference numerals for the lines or are sometimes indicated by the reference numerals themselves, which have been attributed to the lines. Therefore, the notation is such that a line having a certain signal is indicating the signal itself. A line can be a physical line in a hardwired implementation. In a computerized implementation, however, a physical line does not exist, but the signal represented by the line is transmitted from one calculation module to the other calculation module.

Although the present invention has been described in the context of block diagrams where the blocks represent actual or logical hardware components, the present invention can also be implemented by a computer-implemented method. In the latter case, the blocks represent corresponding method steps where these steps stand for the functionalities performed by corresponding logical or physical hardware blocks.

Although some aspects have been described in the context of an apparatus, it is clear that these aspects also represent a description of the corresponding method, where a block or device corresponds to a method step or a feature of a method step. Analogously, aspects described in the context of a method step also represent a description of a corresponding block or item or feature of a corresponding apparatus. Some or all of the method steps may be executed by (or using) a hardware apparatus, like for example, a microprocessor, a programmable computer or an electronic circuit. In some embodiments, some one or more of the most important method steps may be executed by such an apparatus.

The inventive transmitted or encoded signal can be stored on a digital storage medium or can be transmitted on a transmission medium such as a wireless transmission medium or a wired transmission medium such as the Internet.

Depending on certain implementation requirements, embodiments of the invention can be implemented in hardware or in software. The implementation can be performed using a digital storage medium, for example a floppy disc, a DVD, a Blu-Ray, a CD, a ROM, a PROM, and EPROM, an EEPROM or a FLASH memory, having electronically readable control signals stored thereon, which cooperate (or are capable of cooperating) with a programmable computer system such that the respective method is performed. Therefore, the digital storage medium may be computer readable.

Some embodiments according to the invention comprise a data carrier having electronically readable control signals, which are capable of cooperating with a programmable computer system, such that one of the methods described herein is performed.

Generally, embodiments of the present invention can be implemented as a computer program product with a program code, the program code being operative for performing one of the methods when the computer program product runs on a computer. The program code may, for example, be stored on a machine readable carrier.

Other embodiments comprise the computer program for performing one of the methods described herein, stored on a machine readable carrier.

In other words, an embodiment of the inventive method is, therefore, a computer program having a program code for performing one of the methods described herein, when the computer program runs on a computer.

A further embodiment of the inventive method is, therefore, a data carrier (or a non-transitory storage medium such as a digital storage medium, or a computer-readable medium) comprising, recorded thereon, the computer program for performing one of the methods described herein. The data carrier, the digital storage medium or the recorded medium are typically tangible and/or non-transitory.

A further embodiment of the invention method is, therefore, a data stream or a sequence of signals representing the computer program for performing one of the methods described herein.

The data stream or the sequence of signals may, for example, be configured to be transferred via a data communication connection, for example, via the internet.

A further embodiment comprises a processing means, for example, a computer or a programmable logic device, configured to, or adapted to, perform one of the methods described herein.

A further embodiment comprises a computer having installed thereon the computer program for performing one of the methods described herein.

A further embodiment according to the invention comprises an apparatus or a system configured to transfer (for example, electronically or optically) a computer program for performing one of the methods described herein to a receiver. The receiver may, for example, be a computer, a mobile device, a memory device or the like. The apparatus or system may, for example, comprise a file server for transferring the computer program to the receiver.

In some embodiments, a programmable logic device (for example, a field programmable gate array) may be used to perform some or all of the functionalities of the methods described herein. In some embodiments, a field programmable gate array may cooperate with a microprocessor in order to perform one of the methods described herein. Generally, the methods may be performed by any hardware apparatus.

While this invention has been described in terms of several embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations and equivalents as fall within the true spirit and scope of the present invention.

REFERENCES

[1] Daniel W. Griffin and Jae S. Lim, "Signal estimation from modified short-time Fourier transform", IEEE Transactions on Acoustics, Speech and Signal Processing, vol. 32, no. 2, pp. 236-243, April 1984.

[2] Jonathan Le Roux, Nobutaka Ono, and Shigeki Sagayama, "Explicit consistency constraints for STFT spectrograms and their application to phase reconstruction" in Proceedings of the ISCA Tutorial and Research Workshop on Statistical And Perceptual Audition, Brisbane, Australia, September 2008, pp. 23-28.

[3] Xinglei Zhu, Gerald T. Beauregard, and Lonce L. Wyse, "Real-time signal estimation from modified short-time Fourier transform magnitude spectra", IEEE Transactions on Audio, Speech, and Language Processing, vol. 15, no. 5, pp. 1645-1653, July 2007.

[4] Jonathan Le Roux, Hirokazu Kameoka, Nobutaka Ono, and Shigeki Sagayama, "Phase initialization schemes for faster spectrogram-consistency-based signal reconstruction" in Proceedings of the Acoustical Society of Japan Autumn Meeting, September 2010, number 3-10-3.

[5] Nicolas Sturmel and Laurent Daudet, "Signal reconstruction from STFT magnitude: a state of the art" in Proceedings of the International Conference on Digital Audio Effects (DAFx), Paris, France, September 2011, pp. 375-386.

[6] Nathanaël Perraudin, Peter Balazs, and Peter L. Søndergaard, "A fast Griffin-Lim algorithm" in Proceedings IEEE Workshop on Applications of Signal Processing to Audio and Acoustics (WASPAA), New Paltz, N.Y., USA, October 2013, pp. 1-4.

[7] Dennis L. Sun and Julius O. Smith III, "Estimating a signal from a magnitude spectrogram via convex optimization" in Proceedings of the Audio Engineering Society (AES) Convention, San Francisco, USA, October 2012, Preprint 8785.

[8] Tomohiko Nakamura and Hiokazu Kameoka, "Fast signal reconstruction from magnitude spectrogram of continuous wavelet transform based on spectrogram consistency" in Proceedings of the International Conference on Digital Audio Effects (DAFx), Erlangen, Germany, September 2014, pp. 129-135.

[9] Volker Gnann and Martin Spiertz, "Inversion of short-time fourier transform magnitude spectrograms with adaptive window lengths" in Proceedings of the IEEE International Conference on Acoustics, Speech, and Signal Processing, (ICASSP), Taipei, Taiwan, April 2009, pp. 325-328.

[10] Jonathan Le Roux, Hirokazu Kameoka, Nobutaka Ono, and Shigeki Sagayama, "Fast signal reconstruction from magnitude STFT spectrogram based on spectrogram consistency" in Proceedings International Conference on Digital Audio Effects (DAFx), Graz, Austria, September 2010, pp. 397-403.

The invention claimed is:

1. An apparatus for processing an audio signal to acquire a processed audio signal, comprising:

a phase calculator for calculating phase values for spectral values of a sequence of frequency-domain frames representing overlapping frames of the audio signal, wherein the phase calculator is configured to calculate the phase values based on information on a target time-domain envelope related to the processed audio signal, so that the processed audio signal comprises at least in an approximation the target time-domain envelope and a spectral envelope determined by the sequence of frequency-domain frames.

2. The apparatus of claim 1, wherein the phase calculator comprises:

an iteration processor for performing an iterative algorithm to calculate, starting from initial phase values, the phase values for the spectral values using an optimization target entailing consistency of overlapping blocks in the overlapping range, wherein the iteration processor is configured to use, in a further iteration step, an updated phase estimate depending on the target time-domain envelope.

3. Apparatus of claim 1, wherein the phase calculator is configured to apply an amplitude modulation to an intermediate time domain reconstruction of an audio signal based on the target time domain envelope.

4. The apparatus of claim 1, wherein the phase calculator is configured to apply a convolution of a spectral representation of at least one target time-domain envelope and at least one intermediate frequency-domain reconstruction or selected parts or bands or only a high-pass portion or only several bandpass portions of the at least one target time-domain envelope or the at least one intermediate frequency-domain reconstruction of an audio signal.

5. The apparatus of claim 3, wherein the phase calculator comprises:

a frequency-to-time converter for calculating the intermediate time-domain reconstruction of the audio signal from the sequence of frequency-domain frames and initial phase value estimates or phase value estimates of a preceding iteration step, an amplitude modulator for modulating the intermediate time-domain reconstruction using a target time-domain envelope to acquire an amplitude-modulated audio signal, and a time-to-frequency converter for converting the amplitude-modulated signal into a further sequence of frequency-domain frames comprising phase values, and wherein the phase calculator is configured to use, for a next iteration step, the phase values and the spectral values of the sequence of frequency-domain frames.

6. The apparatus of claim 5, wherein the phase calculator is configured to output the intermediate time-domain reconstruction as the processed audio signal, when an iteration determination condition is fulfilled.

7. The apparatus of claim 4, wherein the phase calculator comprises:

a convolution processor for applying a convolution kernel and for applying a shift kernel and for adding an overlapping part of an adjacent frame of a central frame to the central frame to acquire the intermediate frequency-domain reconstruction of the audio signal.

8. The apparatus of claim 4, wherein the phase calculator is configured to use phase values acquired by the convolution as updated phase value estimates for a next iteration step.

9. The apparatus of claim 4, further comprising a target envelope converter for converting the target time-domain envelope into the spectral domain.

10. The apparatus of claim 4, further comprising:

a frequency-to-time converter for calculating the time-domain reconstruction from the intermediate frequency-domain reconstruction using the phase value estimates acquired from a most recent iteration step and the sequence of frequency-domain frames.

11. The apparatus of claim 4, wherein the phase calculator comprises a convolution processor to process the sequence of frequency-domain frames, wherein the convolution processor is configured to apply a time-domain overlap-and-add procedure to the sequence of frequency-domain frames in the frequency-domain to determine the intermediate frequency-domain reconstruction.

12. The apparatus of claim 11, wherein the convolution processor is configured to determine, based on a current frequency-domain frame, a portion of an adjacent frequency-domain frame which contributes to the current frequency-domain frame after time-domain overlap-and-add is performed in the frequency-domain, wherein the convolution processor is further configured to determine an overlapping position of the portion of the adjacent frequency-domain frame within the current frequency-domain frame and to perform an addition of the portions of adjacent frequency-domain frames with the current frequency-domain frame at the overlapping position.

13. The apparatus of claim 11, wherein the convolution processor is configured to frequency-to-time transform a time-domain synthesis and a time-domain analysis window to determine a portion of an adjacent frequency-domain frame which contributes to the current frequency-domain frame after time-domain overlap-and-add is performed in the frequency-domain, wherein the convolution processor is further configured to shift the position of the adjacent frequency-domain frame to an overlapping position within the current frequency-domain frame and to apply the portion of the adjacent frequency-domain frame to the current frame at the overlapping position.

14. The apparatus of claim 1, wherein the phase calculator is configured to perform the iterative algorithm in accordance with the iterative signal reconstruction procedure by Griffin and Lim.

15. An audio decoder, comprising:

the apparatus of claim 1, and an input interface for receiving an encoded signal, the encoded signal comprising a representation of the sequence of frequency-domain frames and a representation of the target time-domain envelope.

16. An audio source separation processor, comprising:

an apparatus for processing of claim 1, and a spectral masker for masking a spectrum of an original audio signal to acquire a modified audio signal input into the apparatus for processing, wherein the processed audio signal is a separated source signal related to the target time-domain envelope.

17. A bandwidth enhancement processor for processing an encoded audio signal, comprising:

an enhancement processor for generating an enhancement signal from an audio signal band comprised by the encoded signal, and an apparatus for processing in accordance with claim 1, wherein the enhancement processor is configured to extract the target time-domain envelope from an encoded representation comprised by the encoded signal or from the audio signal band comprised by the encoded signal.

18. A method for processing an audio signal to acquire a processed audio signal, comprising:

calculating phase values for spectral values of a sequence of frequency-domain frames representing overlapping frames of the audio signal, wherein the phase values are calculated based on information on a target time-domain envelope related to the processed audio signal, so that the processed audio signal comprises at least in an approximation the target time-domain envelope and a spectral envelope determined by the sequence of frequency-domain frames.

19. A method of audio decoding, comprising:

the method for processing an audio signal to acquire a processed audio signal, comprising:

calculating phase values for spectral values of a sequence of frequency-domain frames representing overlapping frames of the audio signal, wherein the phase values are calculated based on information on a target time-domain envelope related to the processed audio signal, so that the processed audio signal comprises at least in an approximation the target time-domain envelope and a spectral envelope determined by the sequence of frequency-domain frames;

receiving an encoded signal, the encoded signal comprising a representation of the sequence of frequency-domain frames, and a representation of the target time-domain envelope.

20. A method of audio source separation, comprising:

the method for processing an audio signal to acquire a processed audio signal, comprising:

calculating phase values for spectral values of a sequence of frequency-domain frames representing overlapping frames of the audio signal, wherein the phase values are calculated based on information on a target time-domain envelope related to the processed audio signal, so that the processed audio signal comprises at least in an approximation the target time-domain envelope and a spectral envelope determined by the sequence of frequency-domain frames, and masking a spectrum of an original audio signal to acquire a modified audio signal input into the apparatus for processing;

wherein the processed audio signal is a separated source signal related to the target time-domain envelope.

21. A method of bandwidth enhancement of an encoded audio signal, comprising:

generating an enhancement signal from an audio signal band comprised by the encoded signal;

the method for processing an audio signal to acquire a processed audio signal, comprising:

calculating phase values for spectral values of a sequence of frequency-domain frames representing overlapping frames of the audio signal, wherein the phase values are calculated based on information on a target time-domain envelope related to the processed audio signal, so that the processed audio signal comprises at least in an approximation the target time-domain envelope and a spectral envelope determined by the sequence of frequency-domain frames;

wherein the generating comprises extracting the target time-domain envelope from an encoded representation comprised by the encoded signal or from the audio signal band comprised by the encoded signal.

22. A non-transitory digital storage medium having a computer program stored thereon to perform a method for processing an audio signal to acquire a processed audio signal, the method comprising:

calculating phase values for spectral values of a sequence of frequency-domain frames representing overlapping frames of the audio signal, wherein the phase values are calculated based on information on a target time-domain envelope related to the processed audio signal, so that the processed audio signal comprises at least in an approximation the target time-domain envelope and a spectral envelope determined by the sequence of frequency-domain frames, when said computer program is run by a computer.

23. A non-transitory digital storage medium having a computer program stored thereon to perform a method of audio decoding, the method comprising:

the method for processing an audio signal to acquire a processed audio signal, comprising:

calculating phase values for spectral values of a sequence of frequency-domain frames representing overlapping frames of the audio signal, wherein the phase values are calculated based on information on a target time-domain envelope related to the processed audio signal, so that the processed audio signal comprises at least in an approximation the target time-domain envelope and a spectral envelope determined by the sequence of frequency-domain frames;

receiving an encoded signal, the encoded signal comprising a representation of the sequence of frequency-domain frames, and a representation of the target time-domain envelope, when said computer program is run by a computer.

24. A non-transitory digital storage medium having a computer program stored thereon to perform a method of audio source separation, the method comprising:

the method for processing an audio signal to acquire a processed audio signal, comprising:

calculating phase values for spectral values of a sequence of frequency-domain frames representing overlapping frames of the audio signal, wherein the phase values are calculated based on information on a target time-domain envelope related to the processed audio signal, so that the processed audio signal comprises at least in an approximation the target time-domain envelope and a spectral envelope determined by the sequence of frequency-domain frames, and masking a spectrum of an original audio signal to acquire a modified audio signal input into the apparatus for processing;

wherein the processed audio signal is a separated source signal related to the target time-domain envelope, when said computer program is run by a computer.

25. A non-transitory digital storage medium having a computer program stored thereon to perform a method of bandwidth enhancement of an encoded audio signal, the method comprising:

generating an enhancement signal from an audio signal band comprised by the encoded signal;

the method for processing an audio signal to acquire a processed audio signal, comprising:

calculating phase values for spectral values of a sequence of frequency-domain frames representing overlapping frames of the audio signal, wherein the phase values are calculated based on information on a target time-domain envelope related to the processed audio signal, so that the processed audio signal comprises at least in an approximation the target time-domain envelope and a spectral envelope determined by the sequence of frequency-domain frames;

wherein the generating comprises extracting the target time-domain envelope from an encoded representation comprised by the encoded signal or from the audio signal band comprised by the encoded signal, when said computer program is run by a computer.

* * * * *